US008491171B2

(12) United States Patent
Okubo

(10) Patent No.: US 8,491,171 B2
(45) Date of Patent: Jul. 23, 2013

(54) VEHICLE HEADLAMP

(75) Inventor: Yasuhiro Okubo, Isehara (JP)

(73) Assignee: Ichikoh Industries, Ltd., Isehara-shi (JP)

( * ) Notice: Subject to any disclaimer, the term of this patent is extended or adjusted under 35 U.S.C. 154(b) by 348 days.

(21) Appl. No.: 13/027,525

(22) Filed: Feb. 15, 2011

(65) Prior Publication Data

US 2011/0199778 A1 Aug. 18, 2011

(30) Foreign Application Priority Data

Feb. 18, 2010 (JP) ..... 2010-033953

(51) Int. Cl.
*F21V 7/00* (2006.01)

(52) U.S. Cl.
USPC ..... 362/517; 362/518; 362/545

(58) Field of Classification Search
USPC ..... 362/459–549
See application file for complete search history.

(56) References Cited

FOREIGN PATENT DOCUMENTS

| | | |
|---|---|---|
| JP | 3740636 B2 | 11/2005 |
| JP | 4023769 B2 | 10/2007 |

*Primary Examiner* — William Carter
(74) *Attorney, Agent, or Firm* — Foley & Lardner LLP

(57) ABSTRACT

The present invention provides: a reflector 3 having a main reflector 2U and second additional reflection surfaces 9, 9; a semiconductor-type light source 5U; a light shading member 12U having first additional reflection surfaces 15U, 15U; and a shades 13U, 13U, 14U, 14U. The main reflection surface 2U reflects light L1 emitted from the semiconductor-type light source 5U and then emits a light distribution pattern LP for low beam. The first additional reflection surfaces 15U, 15U and the second additional reflection surfaces 9, 9 reflect light L2 emitted from the semiconductor-type light source 5U and then emit an additional light distribution pattern LP1. As a result, the present invention can form a main light distribution pattern and prevents the leakage of the light emitted from the semiconductor-type light source 5U through the light shading member 12U.

8 Claims, 20 Drawing Sheets

VEHICLE HEADLAMP

CROSS REFERENCE TO RELATED APPLICATIONS

This application claims priority of Japanese Patent Application No. 2010-033953 filed on Feb. 18, 2010. The contents of this application are incorporated herein by reference in their entirety.

BACKGROUND OF THE INVENTION

1. Field of the Invention

The present invention relates to a vehicle headlamp using a semiconductor-type light source as a light source. In particular, the present invention relates to a vehicle headlamp efficiently utilizing light emitted from the semiconductor-type light source.

2. Description of the Related Art

A vehicle headlamp which uses an LED lamp as a light source and efficiently utilizes light emitted from the LED lamp is conventionally known (Japanese Patent No. 4023769, for example). In addition, a headlamp which efficiently utilizes light emitted from a light emitting source of a bulb is conventionally known (Japanese Patent No. 3740636, for example).

The conventional former vehicle lighting device is a signal lamp such as a tale lamp and efficiently utilizes the light emitted from the LCD lamp by means of a first reflection surface, a second reflection surface, a third reflection surface, and a fourth reflection surface to thereby expand an area of light emission from the LED lamp. However, the conventional former vehicle lighting device cannot form a predetermined main light distribution pattern of the vehicle headlamp, for example, a light distribution pattern for low beam (a light distribution pattern for passing) or a light distribution pattern for high beam (a light distribution pattern for running) by means of the first reflection surface. In addition, the conventional latter headlamp efficiently utilizes light emitted from the light emitting source of the bulb by: forming light distribution for passing, by means of a main reflection surface; and reflecting invalid light emitted from the light emitting source of the bulb to an opening side of a shield plate downward of the bulb by means of a right elliptical reflection surface and a left elliptical reflection surface and then reflecting the reflected light passing through the opening of the shield plate by means of a right parabolic reflection surface and a left parabolic reflection surface. However, in the conventional latter headlamp, the shield plate is provided downward of the bulb in order to form the light emitted from the light emitting source of the bulb by means of the main reflection surface and on the shield plate, an opening is provided for passing the reflected light beams from the right elliptical reflection surface and the left elliptical reflection surface through the right parabolic reflection surface and the left parabolic reflection surface. Therefore, there has been a problem that the light emitted from the light emitting source of the bulb leaks from the opening of the shield plate.

The present invention has been made in order to solve the above-described two problems that: the conventional former vehicle lighting device cannot form the predetermined main light distribution pattern of the vehicle headlamp; and that in the conventional latter headlamp, the light emitted from the light emitting source of the bulb leaks from the opening of the shield plate.

SUMMARY OF THE INVENTION

A first aspect of the present invention is directed to a vehicle headlamp whose semiconductor-type light source is used as a light source, the vehicle headlamp comprising: a reflector having a main reflection surface that is made up of a parabolic free curved face; a semiconductor-type light source having a light emitting chip; and a light shading member, wherein: a center of the light emitting chip is positioned at or near a reference focal point of the main reflection surface and is positioned on a reference optical axis of the main reflection surface; a light emitting surface of the light emitting chip is oriented in a vertical axis direction; the main reflection surface is a main reflection surface which is disposed in a space at a side opposite to the light emitting surface of the light emitting chip and which is adapted to reflect light radiated from the light emitting surface of the light emitting chip and then emit the reflected light to a forward direction of a vehicle in a predetermined main light distribution pattern; the light shading member which is disposed in at least a space other than an optical path which is emitted with light from the main reflection surface to the forward direction of the vehicle and is adapted to shade light directly radiated from the light emitting surface of the light emitting chip to the forward direction of the vehicle; on the light shading member, there is provided: a first additional reflection surface that is made up of an elliptical free curved face in which a first reference focal point is positioned at or near a reference focal point of the main reflection face and a second reference focal point is positioned on a reference optical axis of the main reflection surface and a horizontal axis orthogonal to the vertical axis or at an opposite side to a side opposing to a light emitting surface of the light emitting chip of the horizontal axis, the first additional reflection surface being adapted to converge and reflect light directly radiated from the light emitting surface of the light emitting chip to the forward direction of the vehicle on the second reference focal point; and at a site other than the main reflection surface and at an opposite side to a side opposing to the light emitting surface of the light emitting chip of the main reflection surface, of the reflector, there is provided a second additional reflection surface that is made up of a parabolic free curved face in which a reference focal point is positioned at or near a second reference focal point of the first additional reflection surface, the second additional reflection surface being adapted to reflect reflected light from the first additional reflection surface and then emit the reflected light to the forward direction of the vehicle in a predetermined additional light distribution pattern.

In addition, a second aspect of the present invention is directed to the vehicle headlamp according to the first aspect, wherein: the first additional reflection surface is made up of two elliptical free curved faces in which the first reference focal point is shared and the second reference focal point are positioned at each of the left and right sides with respect to the semiconductor-type light source; and the second additional reflection surface is made up of two parabolic free curved faces that are positioned at both the left and right sides with respect to the semiconductor-type light source.

Further, a third aspect of the present invention is directed to the vehicle headlamp according to the first aspect, wherein the main reflection surface, the semiconductor-type light source, the light shading member, one or two of the first additional reflection surfaces, and one or two of the second additional reflection surfaces are disposed so that an upside unit in which the light emitting surface of the light emitting chip is oriented upward in a vertical axis direction and a downside unit in which the light emitting surface of the light emitting chip is oriented downward in the vertical axis direction are established in a point-symmetrical state.

Furthermore, a fourth aspect of the present invention is directed to the vehicle headlamp according to the first aspect, wherein: the main light distribution pattern is a main distribution pattern having a cutoff line and at least one shade adapted to form an additional light distribution pattern having a cutoff line is provided in a space other than the optical path which is emitted with light from the main reflection surface to the forward direction of the vehicle and between the first additional reflection surface and the second reflection surface.

Still furthermore, a fifth aspect of the present invention is directed to the vehicle headlamp according to the fourth aspect, wherein: the first additional reflection surface is made up of an elliptical free curved face in which the first reference focal point is shared and the second reference focal point is positioned at each of the left and right sides with respect to the semiconductor-type light source; the second additional reflection surface is made up of two parabolic free curved faces that are positioned at both of the left and right sides with respect to the semiconductor-type light source; and the at least one shade is made up of two shades that are provided between two of the first additional reflection surfaces and two of the second additional reflection surfaces, respectively.

Yet furthermore, a sixth aspect of the present invention is directed to the vehicle headlamp according to the fourth aspect, wherein the shade is positioned at or near the second reference focal point of the first additional reflection surface.

Furthermore, a seventh aspect of the present invention is directed to the vehicle headlamp according to the fourth aspect, wherein: the main reflection surface, the semiconductor-type light source, the light shading member, one or two of the first additional reflection surfaces, and one or two of the second additional reflection surfaces are provided so that the upside unit in which the light emitting surface of the light emitting chip is oriented upward in a vertical axis direction and the downside unit in which the light emitting surface of the light emitting chip are oriented downward in the vertical axis direction are established in a point-symmetrical state; and one or two of the two shades are provided at the upside unit in which the light emitting face of the light emitting chip is oriented upward in the vertical axis direction and at the downside unit in which the light emitting face of the light emitting chip is downward in the vertical axis direction, respectively.

Still furthermore, an eighth aspect of the present invention is directed to the vehicle headlamp according to the first aspect, wherein one or two of the second additional reflection surfaces of the upside unit and one or two of the second additional reflection surfaces of the downside unit are disposed between the main reflection surface of the upside unit and the main reflection surface of the downside unit.

In the vehicle headlamp according to the first aspect of the present invention, when a light emitting chip of a semiconductor-type light source is illuminated to emit light by a means for solving the above-described problems, a part of the light radiated from the light emitting chip is reflected by means of a main reflection surface and then the reflected light is emitted as a predetermined light distribution pattern to a forward direction of a vehicle. Thus, the vehicle headlamp according to the first aspect of the present invention can form a predetermined light distribution pattern by means of the main reflection surface. On the other hand, in the vehicle headlamp according to the first aspect of the present invention, light directly radiated from the light emitting chip to the forward direction of the vehicle is reflected by means of the first additional reflection surface on a horizontal axis or at an opposite side to a side opposing to the light emitting surface of the light emitting chip more than the horizontal axis; and the reflected light is emitted as a predetermined additional light distribution pattern to the forward direction of the vehicle. Therefore, in the vehicle headlamp according to the first aspect of the present invention, without providing an opening at a light shading member, the light directly radiated from the light emitting chip to the forward direction of the vehicle can be reflected to a second additional reflection surface side by means of a first additional reflection surface that is provided at the light shading member, whereby the reflected light can be emitted as a predetermined additional light distribution pattern to the forward direction of the vehicle. As a result, in the vehicle headlamp according to the first aspect of the present invention, the light directly radiated from the light emitting chip to the forward direction of the vehicle is shaded more reliably by means of the light shading member having the first additional reflection surface. Therefore, the light directly radiated from the light emitting chip to the forward direction of the vehicle does not leak to the outside.

Moreover, in the vehicle headlamp according to the first aspect of the present invention, a light shading member having a first additional reflection surface is disposed in at least a space other than an optical path which is emitted with light from a main reflection surface to the forward direction of the vehicle. Thus, the light shading member having the first additional reflection surface does not interfere with an optical path of a main light distribution pattern that is emitted from the main reflection surface to the forward direction of the vehicle. As a result, in the vehicle headlamp according to the first aspect of the present invention, the reflected light from the main reflection surface is not shaded by means of the light shading member having the first additional reflection surface and almost all of the light can be efficiently utilized as the main light distribution pattern. In addition, a failure such as partial lowering of a light quantity (luminous intensity, intensity of illumination) in the main light distribution pattern by means of the light shading member having the first additional reflection surface is unlikely to occur.

Moreover, in the vehicle headlamp according to the first aspect of the present invention, a second additional reflection surface is provided at a site other than a main reflection surface and at an opposite side to a side opposing to the light emitting surface of the light emitting chip of the main reflection surface, of a reflector, so that a part of the main reflection surface is not eroded by the second additional reflection surface. As a result, in the vehicle headlamp according to the first aspect of the present invention, the light quantity (luminous intensity, intensity of illumination) of the main light distribution pattern that is formed by the existing main reflection surface can be maintained as is, whereas invalid light emitted from the light emitting chip is efficiently utilized by means of a first additional reflection surface and a second additional reflection surface, both of which are newly provided, so that the light quantity (luminous intensity, intensity of illumination) can be efficiently utilized with respect to the liquid quantity (luminous intensity, intensity of illumination) of the main light distribution pattern.

In addition, in the vehicle headlamp according to the second aspect of the present invention, the first additional reflection surface is made up of two elliptical free curved faces defined at both of the left and right sides thereof; and the second additional reflection surface is made up of two parabolic free curved faces defined at both of the left and right sides thereof, so that: the light directly radiated from the light emitting chip to the forward direction of the vehicle can be emitted as a predetermined additional light distribution pattern to the forward direction of the vehicle by means of two of the first additional reflection surfaces and two of the second additional reflection surfaces; and the light emitted from the semiconductor-type light source can be utilized further efficiently and reliably in comparison with one of the first additional reflection surfaces and one of the second additional reflection surfaces.

Further, with respect to the vehicle headlamp according to the third aspect of the present invention, in the main reflection surface, there are disposed: the semiconductor-type light source; the light shading member; one or two of the first additional reflection surfaces; one or two of the second additional reflection surfaces; and the light emitting surface of the light emitting chip, so that an upside unit in which the light emitting surface of the light emitting chip is oriented downward in a vertical axis direction and a downside unit in which the light emitting surface of the light emitting chip is oriented downward in the vertical axis direction are established in a point-symmetrical state. As a result, in the vehicle headlamp according to the third aspect of the present invention, even if a reflector is reduced in size, the light quantity (luminous intensity, intensity of illumination) of the main light distribution pattern and the additional light distribution pattern can be sufficiently obtained, so that optically distributing and controlling a main light distribution pattern and an additional light distribution pattern that are optimal for use in vehicle can be compatible with downsizing of a lamp unit.

Furthermore, in the vehicle headlamp of the fourth aspect of the present invention, a main light distribution pattern having a cutoff line is formed by means of a main reflection surface, whereas an additional light distribution pattern having a cutoff line is formed by means of at least one shade. As a result, in the vehicle headlamp according to the fourth aspect of the present invention, a light distribution pattern having a cutoff line of which light quantity (luminous intensity, intensity of illumination) is increased can be easily and reliably obtained by means of the main light distribution pattern having the cutoff line and the additional light distribution pattern having the cutoff line.

Moreover, in the vehicle headlamp according to the fourth aspect of the present invention, at least one shade is disposed in a space other than an optical path which is emitted with light from a main reflection surface to a forward direction of a vehicle and between a first additional reflection surface and a second additional reflection surface. Therefore, the at least one shade does not interfere with the optical path of the main light distribution pattern emitted from the main reflection surface to the forward direction of the vehicle. As a result, the vehicle headlamp of the fourth aspect of the present invention can efficiently utilize almost all of the reflected light from the main reflection surface as a main light distribution pattern having a cutoff line. In addition, a failure such as partial lowering of light quantity (luminous intensity, intensity of illumination) in main light distribution pattern having a cutoff line by means of the at least one shade does not occur.

Furthermore, in the vehicle headlamp according to the fifth aspect of the present invention, the first additional reflection surface is made up of two elliptical free curved face; the second additional reflection surface is made up of two parabolic free curved face; the at least one shade is made up of two shades, so that: light directly radiated from a light emitting chip to the forward direction of the forward direction of the vehicle can be emitted to the forward direction of the vehicle as an additional light distribution pattern having a predetermined cutoff line by means of two of the first additional reflection surfaces, two of the second additional reflection surfaces, and two of the shades; and light emitted from the semiconductor light source can be utilized further efficiently and reliably in comparison with one of the first additional reflection surfaces and one of the second additional reflection surfaces.

Still furthermore, in the vehicle headlamp according to the sixth aspect of the present invention, the shade is positioned at or near the second reference focal point of the first additional reflection surface, so that reflected light converging at the second reference focal point of the first reflection surface or reflected light radiated (diffused) from the second reference focal point of the first additional reference surface can be controlled to be optically distributed precisely and easily into an additional light distribution pattern having a cutoff line.

Yet furthermore, in the vehicle headlamp according to the seventh aspect of the present invention, the main reflection surface, the semiconductor-type light source, the light shading member, one or two of the first additional reflection surfaces, one or two of the second additional reflection surface, and one of two of the shades are provided at the upside unit in which the light emitting surface of the light emitting chip is oriented upward in a vertical axis direction and at the downside unit in which the light emitting surface of the light emitting chip are downward in the vertical axis direction. As a result, in the vehicle headlamp according to the seventh aspect of the present invention, even if a reflector is reduced in size, the light quantity (luminous intensity, intensity of illumination) of the main light distribution pattern and the additional light distribution pattern can be sufficiently obtained, so that optical distributing and controlling a main light distribution pattern and an additional light distribution pattern that are optimal for use in vehicle can be compatible with downsizing of a lamp unit.

Furthermore, in the vehicle headlamp according to the eighth aspect of the present invention, one or two of the second additional reflection surface of the upside unit and one or more of the second additional reflection surfaces of the downside unit are disposed between the main reflection surface of the upside unit and the main reflection surface of the downside unit. As a result, the vehicle headlamp according to the eighth aspect of the present invention entirely illuminates one or two of the second additional reflection surfaces of the upside unit and one or two of the second additional reflection surfaces of the downside unit, a respective one or respective ones of which are positioned partway; the main reflection surface of the upside unit, which is positioned at the upper side; and the main reflection surface of the downside unit, which is positioned at the lower side. Therefore, in the vehicle headlamp of the eighth aspect of the present invention, visibility or quality is improved because a non-luminous portion is not formed between the main reflection surface of the upside unit and the main reflection surface of the downside unit.

DESCRIPTION OF THE PREFERRED EMBODIMENTS

Figure 15:
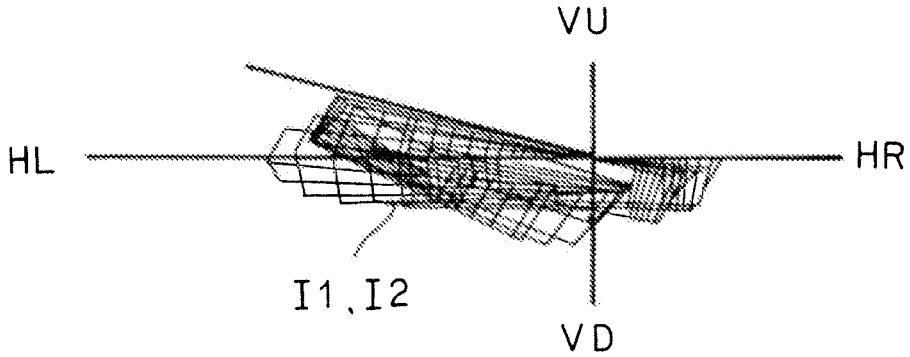
FIG. 15 is an explanatory view showing a reflection image group of a light emitting chip, the reflection image group being obtained by the first reflection surface that is made up of the fourth segment, similarly.
Figure 16:
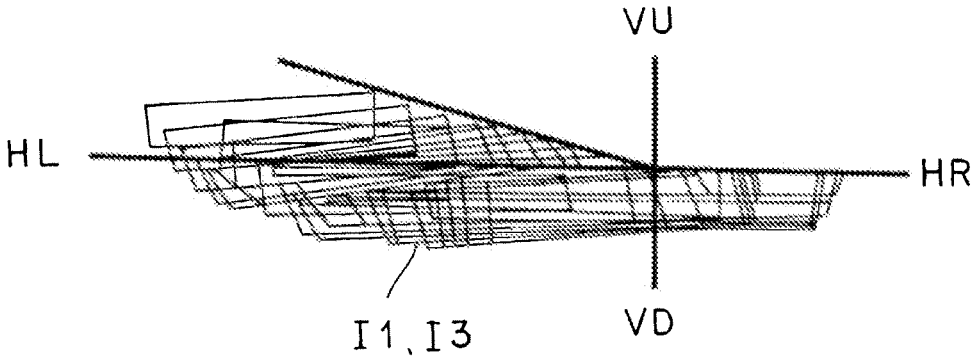
FIG. 16 is an explanatory view showing a reflection image group of a light emitting chip, the reflection image group being obtained by the second reflection surface that is made up of the fifth segment, similarly.

Hereinafter, first to third embodiments of the preferred embodiments of a vehicle headlamp according to the present invention will be described in detail with reference to the drawings. It should be noted that the present invention is limited by the embodiments. In FIG. 1 to FIG. 3, FIG. 18, and FIG. 19, a heat sink member is not shown. FIG. 15 and FIG. 16 are explanatory views showing a reflection image group of a light emitting chip on a screen, which is obtained through a computer simulation. In FIG. 15 to FIG. 17 and FIG. 26, the letter sign "VU-VD" designates a vertical line of a top and a bottom of a screen; and the letter sign "HL-HR" designates a horizontal line of a left and a right of the screen. In the specification and claims, the terms "top", "bottom", "front", "rear", "left", and "right" designate the top, bottom, front, rear, left, and right of a vehicle when the vehicle headlamp according to the present invention is mounted on a vehicle (an automobile).

First Embodiment

Figure 17:
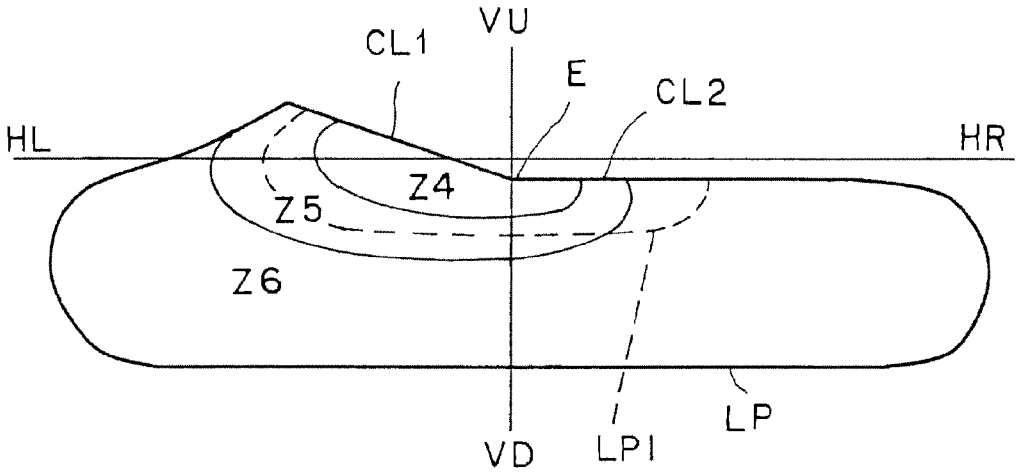
FIG. 17 is an explanatory view showing a light distribution pattern for low beam, the pattern having an oblique cutoff line and a horizontal cutoff line, similarly.
Figure 18:
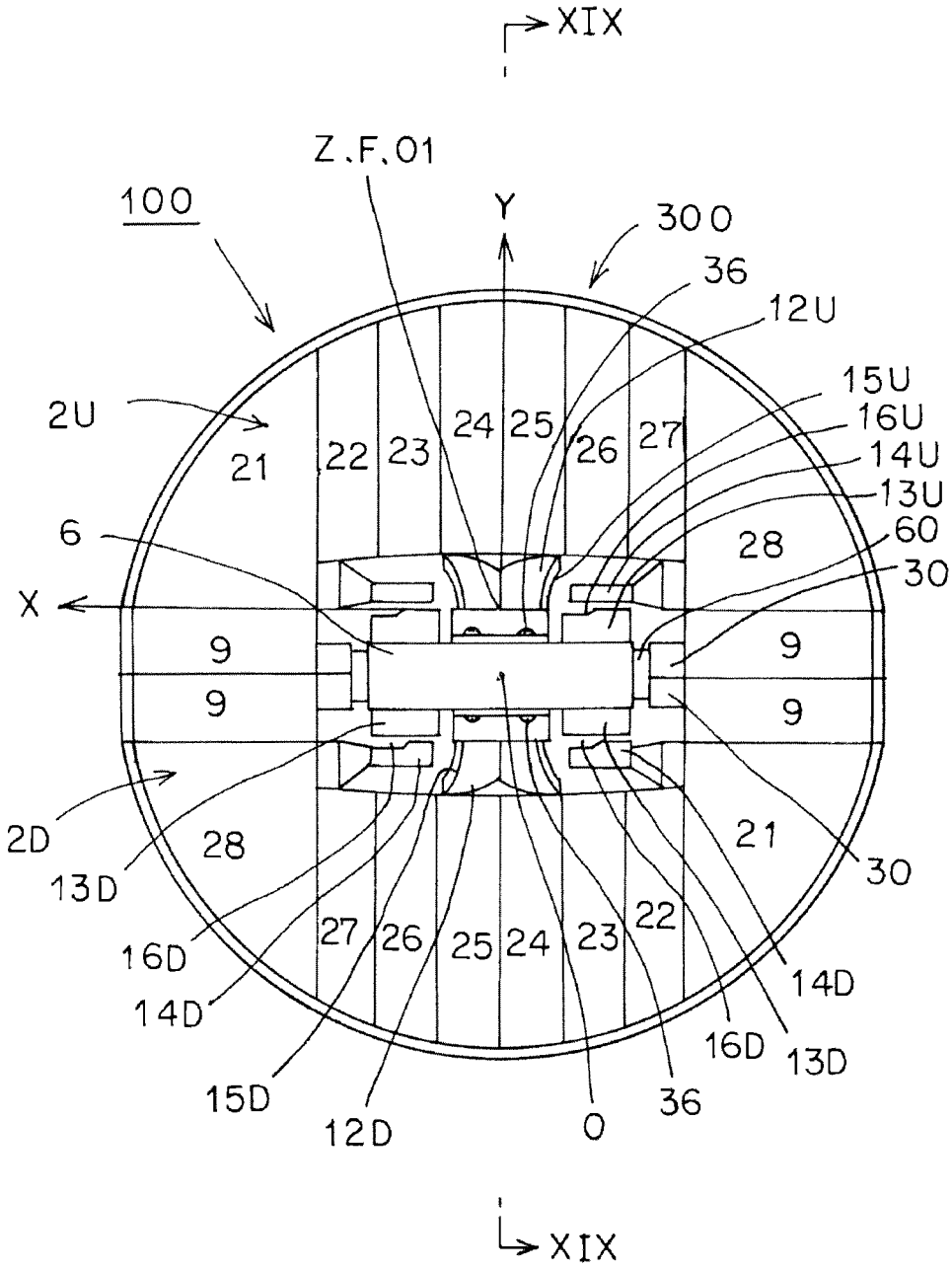
FIG. 18 is a front view of the essential portions showing a vehicle headlamp according to a second embodiment of the present invention.

FIG. 1 to FIG. 17 show a vehicle headlamp according to a first embodiment of the present invention. Hereinafter, a configuration of the vehicle headlamp in the first embodiment will be described. In the figures, reference numeral 1 designates the vehicle headlamp (an automobile headlamp) in the first embodiment. The vehicle headlamp 1, as shown in FIG. 17, has an oblique cutoff line CL1 on a running lane side (a left side) with an elbow point E being a turning point. This headlamp is also adapted to emit a light distribution pattern having a horizontal cutoff line CL2, for example, a light distribution pattern for low beam (a light distribution pattern for passing) LP to an opposite lane side (a right side), i.e., to a forward direction of a running vehicle. An angle formed between the oblique cutoff line CL1 and a horizontal line HL-HR of a screen is about 15 degrees.

The vehicle headlamp 1 is made up of: a reflector 3 having an upper main reflection surface 2U that is made up of a parabolic free curved face (a NURBS curved face); an upper semiconductor-type light source 5U having a light emitting chip 4 that is shaped like a planar rectangle (a planar elongated rectangle); a holder 6; a head sink 7; a light shading member 12U; two shades 13U, 13U, 14U, 14U; and a lamp housing and a lamp lens (such as a transparent outer lens, for example), although not shown.

The holder 6 forms a plate-like shape having an upper fixing face and a lower fixing face. The holder 6 is made up of a resin member or a metal member having high thermal conductivity, for example. The head sink member 7 forms a trapezoidal shape having an upper fixing face at an upper portion thereof and forms a fin-like shape from a middle part to a lower portion. The heat sink member 7 is made up of a resin member or a metal member having high thermal conductivity, for example.

A lamp unit is configured with the reflector 3, the upper semiconductor-type light source 5U, the holder 6, the heat sink member 7, the light shading member 12U, and two of the shades 13U, 13U, 14U, 14U.

In other words, the reflector 3 is fixed and held on the holder 6. Hereinafter, a further detailed description will be given. Fixing portions 30 and 60 are integrally provided at each of the left and right sides of a window portion 8 of the reflector 3 and each of the left and right sides of the holder 6, respectively. The fixing portion 30 of the reflector 3 is fixed and held at the fixing portion 60 of the holder 6 by means of a screw 36 or a fixing member (an elastic engagement between an elastic hook and an engagement portion, a so called patching engagement).

The upper semiconductor-type light source 5U is fixed and held on an upper fixing face of the holder 6 by means of a fixing member (a screw or an elastic engagement between an elastic hook and an engagement portion, a so called patching engagement), although not shown. The holder 6 is fixed at an upper fixing face by means of a screw 36 or a fixing member (an elastic engagement between an elastic hook and an engagement portion, a so called patching engagement). The light shading member 12U is fixed at a center of the upper fixing face of the holder 6 by means of a screw 36 or a fixing member (an elastic engagement between an elastic hook and an engagement portion, a so called patching engagement).

Two of the shades are made up of first shades 13U, 13U, and second shades 14U, 14U. Two of the first shades 13U, 13U are integrally formed with each other at both of the left and right sides of the upper fixing face of the holder 6. Alternatively, these two shades are integrally fixed with each other by means of a fixing member (a screw or an elastic engagement between an elastic hook and an engagement portion, a so called patching engagement). On the other hand, two of the second shades 14U, 14U are integrally formed with each other at both of the left and right sides of the window portion 8 of the reflector 3. These two shades are also integrally fixed with each other by means of a fixing member (a screw or an elastic engagement between an elastic hook and an engagement portion, a so called patching engagement).

The constituent elements of the lamp unit, designated by reference numerals 3, 5U, 6, 7, 12U, 13U, 13U, 14U, 14U are disposed via an optical axis adjusting mechanism, for example, in a lamp room which is partitioned by the lamp housing and the lamp lens. In the lamp room, there may be disposed another lamp unit such as a fog lamp, a cornering lamp, a clearance lamp, or a turn signal lamp other than the constituent elements of the lamp unit, designated by reference numerals 3, 5U, 6, 7, 12U, 13U, 13U, 14U, 14U.

The upper main reflection surface 2U, the upper semiconductor-type light source 5U, the upper light shading member 12U, and the upper two shades 13U, 13U, 14U, 14U constitute an upside unit in which a light emitting surface of the light emitting chip 4 is oriented upward in a vertical Y-axis direction.

The reflector 3 is made up of an optically opaque resin member, for example. The reflector 3 forms a portion corresponding to an upper halve of a substantial rotational parabolic face on which an axis passing through a center point (not shown) is defined as a rotary axis. A front side of the reflector 3 is opened in a substantially semicircular shape of the upper halve. The size of an opening at the front side of the reflector 3 is equal to or smaller than about 100 mm in diameter. On the other hand, a rear side of the reflector 3 is closed. The window portion 8 that is formed in the shape of a substantially transversely elongated rectangle is provided at an intermediate part of the closed portion of the reflector 3. The holder 6 is inserted into the window portion 8 of the reflector 3.

Among inside (front-side) faces of the closed portion of the reflector 3, the upper main reflection surface 2U is provided on an upper face of the window portion 8. The upper main reflection surface 2U made up of a parabolic free curbed face (a NURBS curved face) has a reference focal point (a pseudo focal point) F and a reference optical axis (a pseudo optical axis) Z. Among the interior (front) faces of the closed portion of the reflector 3, both of the left and right faces of the window portion 8 being faces defined at a lower portion of the upper main reflection surface 2U are faces which the light radiated from a light emitting surface of the light emitting chip 4 of the upper semiconductor-type light source 5U does not reach, i.e., from non-luminous surfaces 9, 9.

Figure 9:
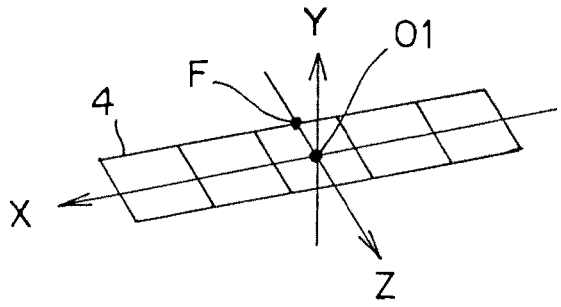
FIG. 9 is an explanatory perspective view showing a relative position relationship between a center of a light emitting chip and a reference focal point of a reflection surface, similarly.
Figure 10:
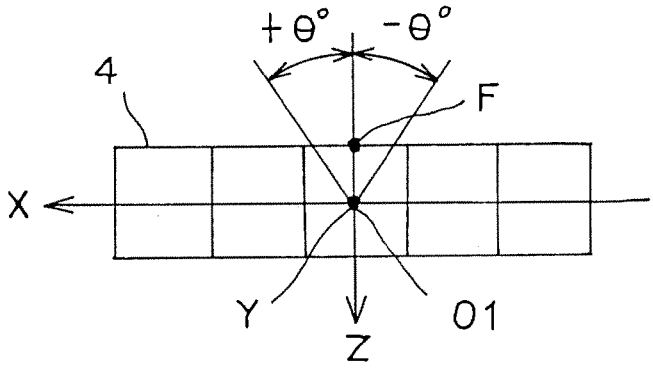
FIG. 10 is an explanatory plan view showing the relative position relationship between the center of the light emitting chip and the reference focal point of the reflection surface, similarly.

The semiconductor-type light source 5U is made up of: a board 10; the light emitting chip 4 provided on the board 10; and a sealing resin member 11 that is formed in a thin rectangular parallelepiped shape, the sealing member for sealing the light emitting chip 4. The light emitting chip 4, as shown in FIG. 9 and FIG. 10, is formed in such a manner that five square chips are arranged in a horizontal X-axis direction. One rectangular chip may be used.

A center O1 of the light emitting chip 4 is positioned at or near a reference focal point F of the main reflection surface 2U and is positioned on a reference optical axis Z of the main reflection surface 2U. In addition, a light emitting surface of the light emitting chip 4 (a face on an opposite side to a face opposite to the board 10) is oriented in a vertical Y-axis direction. In other words, the light emitting surface of the light emitting chip 4 of the upper semiconductor-type light source 5U is oriented upward in the vertical Y-axis direction. Further, a longer edge of the light emitting chip 4 is parallel to the horizontal axis X that is orthogonal to the reference optical axis Z and the vertical axis Y.

The horizontal axis X, the vertical axis Y, and the reference optical axis Z constitute an orthogonal coordinate (an X-Y-Z orthogonal coordinate system) while the center O1 of the light emitting chip 4 is defined as an origin. In the horizontal axis X, in the case of the constituent elements of the upside unit, designated by reference numerals 2U, 5U, 12U, 13U, 13U, 14U, 14U, an upper side corresponds to a positive direction and a lower side corresponds to a negative direction. In the vertical axis Y, in the case of the upside unit, designated by reference numerals 2U, 5U, 12U, 13U, 13U, 14U, 14U, an upper side corresponding to a positive direction and a lower side corresponds to a negative direction. In the reference optical axis Z, in the case of the constituent elements of the upside unit, designated by reference numerals 2U, 5U, 12U, 13U, 13U, 14U, 14U, a front side corresponds to a positive direction and a rear side corresponds to a negative direction.

The main reflection surface 2U is made up of a parabolic free curved face (a NURBS curved face). The reference focal point F of the main reflection surface 2U is positioned on the reference optical axis Z and between the center O1 of the light emitting chip 4 and a longer edge at a rear side of the light emitting chip 4. In the embodiment, this focal point is positioned at the longer edge at the rear side of the light emitting chip 4. In addition, a reference focal length of the main reflection surface 2U is about 10 mm to 18 mm. The main reflection surface 2U is disposed in a range from a plane including the light emitting surface of the light emitting chip 4 (a plane including the horizontal axis X and the reference optical axis Z) to a space at a side opposite to the light emitting face of the light emitting chip 4 (an upward-oriented space of the vertical axis Y).

The main reflection surface 2U is made up of segments 21, 22, 23, 24, 25, 26, 27, 28 divided into eight sections in the vertical Y-axis direction. A fourth segment 24 of a center portion constitutes a first reflection surface. In addition, a fifth segment 25 of the center part constitutes a second reflection surface. Further, a first segment 21, a second segment 22, a third segment 23, a sixth segment 26, a seventh segment 27, and an eighth segment 28 of end parts constitute a third reflection surface.

Figure 7:
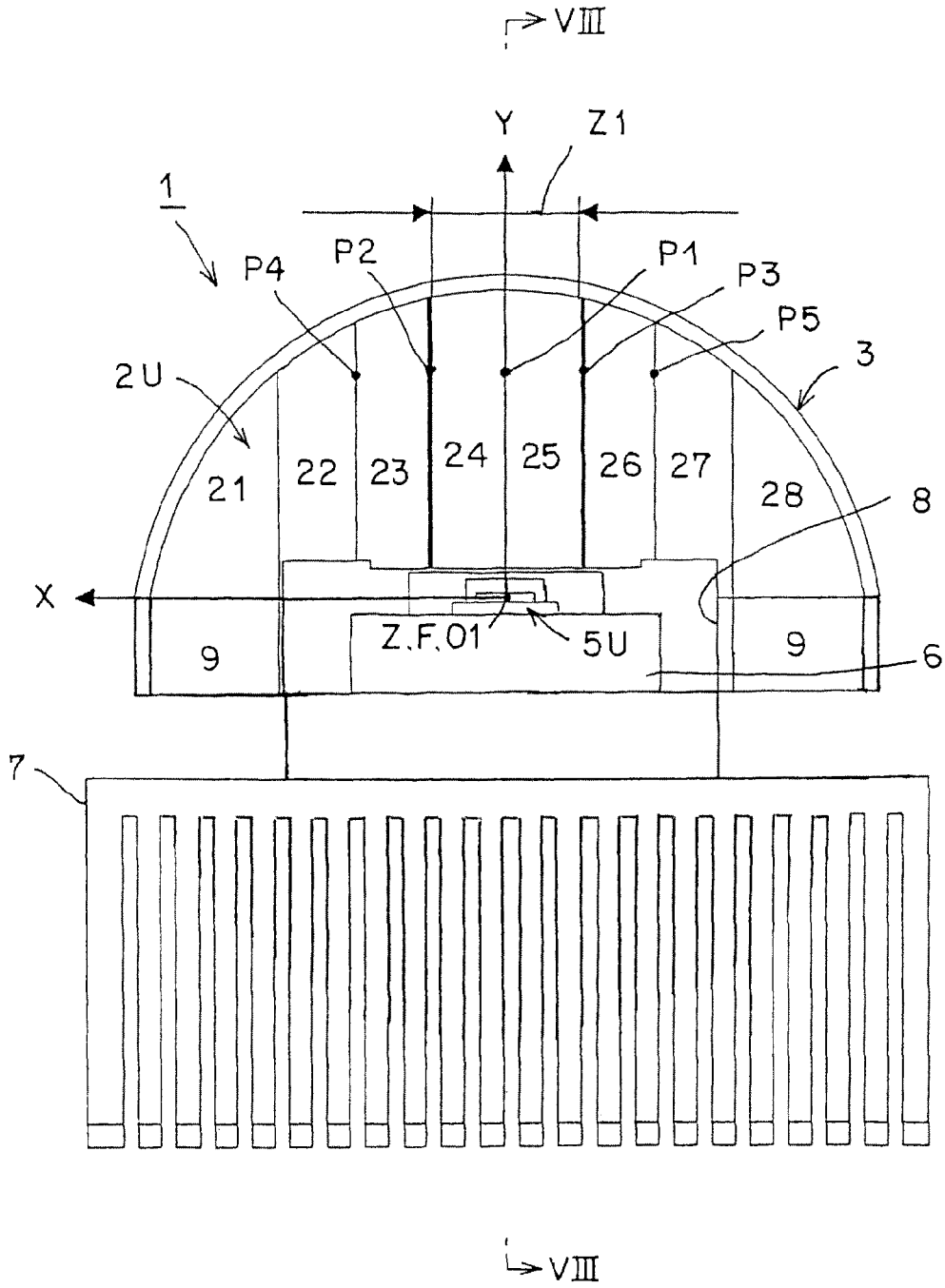
FIG. 7 is a front view showing the essential portions in the state in which the light shading member, the first additional reflection surface, and the shade are removed, similarly.
Figure 11:
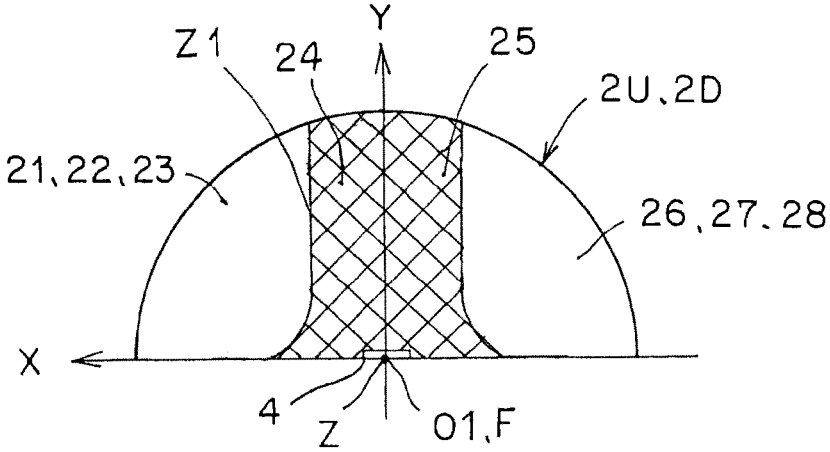
FIG. 11 is an explanatory front view showing a range in which a first reflection surface that is made up of a fourth segment and a second reflection surface that is made up of a fifth segment are provided, similarly.

The fourth segment 24 of the first reflection surface and the fifth segment 25 of the second reflection surface, of the center portion, is provided in a range Z1 between two longitudinal thick solid lines in FIG. 7 and in a range Z1 that is indicated by the lattice oblique lines in FIG. 11. In other words, these two segments are positioned in a range Z1 which is within a latitude angle of ∓40 degrees (∓θ degrees in FIG. 10) from the center O1 of the light emitting chip 4. The first segment 21, the second segment 22, the third segment 23, the sixth segment 26, the seventh segment 27, and the eighth segment 28 of the third reflection of the end parts are provided in a range that is indicated by a white-based color in FIG. 11 other than the range Z1. In other words, these six segments are provided within a range from the center O1 of the light emitting chip 4 to a latitude angle of ∓40 degrees or wider.

Figure 12:
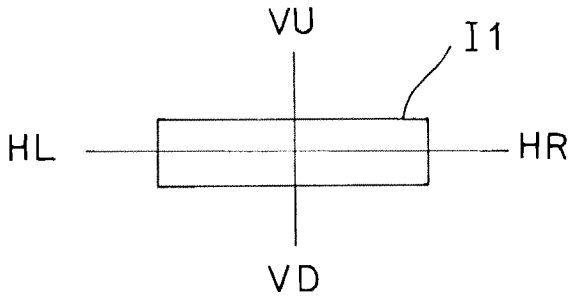
FIG. 12 is an explanatory view showing a reflection image of a light emitting chip, the reflection image being obtained at a point P1 of a reflection surface, similarly.
Figure 13:
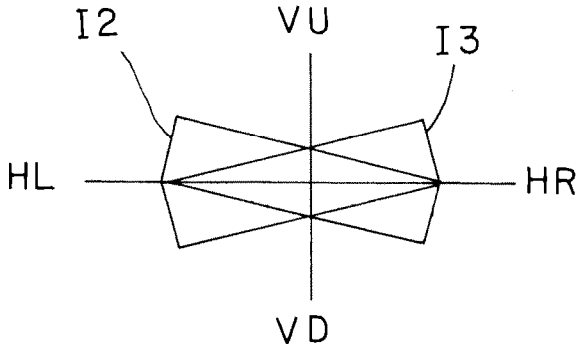
FIG. 13 is an explanatory view showing a reflection image of a light emitting chip, the reflection image being obtained at points P2, P3 of a reflection surface, similarly.
Figure 14:
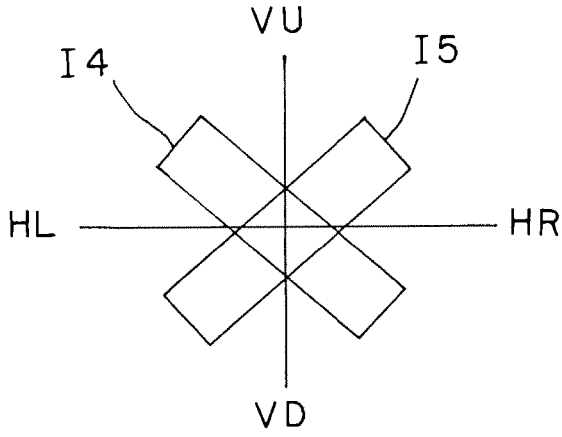
FIG. 14 is an explanatory view showing a reflection image of a light emitting chip, the reflection image being obtained at points P4, P5 of a reflection surface, similarly.

Hereinafter, with reference to FIG. 12, FIG. 13, and FIG. 14, a description will be given with respect to a reflection image (a screen map) of the light emitting chip 4 formed in a planar rectangle shape that is obtained in each of the segments 21 to 28 of the main reflection surface 2U. In other words, in a boundary P1 between a fourth segment 24 and a fifth segment 25, as shown in FIG. 12, a reflection image I1 of the light emitting chip 4 having a tilt angle of about 0 degree can be obtained with respect to a horizontal line HL-HR of a screen. In addition, in a boundary P2 between a third segment 23 and the fourth segment 24, as shown in FIG. 13, a reflection image I2 of the light emitting chip 4 having a tilt angle of about 20 degrees can be obtained with respect to the horizontal line HL-HR of the screen. Further, in a boundary P3 between a fifth segment 25 and a sixth segment 26, as shown in FIG. 13, a reflection image I3 of the light emitting chip having a tilt angle of about 20 degrees can be obtained with respect to the horizontal line HL-HR of the screen. Furthermore, in a boundary P4 between a second segment 22 and a third segment 23, as shown in FIG. 14, a reflection image I4 of the light emitting chip 4 having a tilt angle of about 40 degrees can be obtained with respect to a horizontal line HL-HR of the screen. Still furthermore, in a boundary P5 between a sixth segment 26 and a seventh segment 27, as shown in FIG. 14, a reflection image I5 of the light emitting chip 4 having a tilt angle of about 40 degrees can be obtained with respect to the horizontal line HL-HR of the screen.

As a result, in the fourth segment 24 of the main reflection surface 2U, reflection images from the reflection image I1 having the tilt angle of about 0 degrees shown in FIG. 12 to the reflection image I2 having the tilt angle of about 20 degrees shown in FIG. 13 can be obtained. In addition, in the fifth segment 25 of the main reflection surface 2U, reflection images from the reflection image I1 having the tilt angle of 0 degrees shown in FIG. 12 to the reflection image I3 having the tilt angle of about 20 degrees shown in FIG. 13 can be obtained. Further, in the third segment 23 of the main reflection surface 2U, reflection images from the reflection image I2 having the tilt angle of about 20 degrees shown in FIG. 13 to the reflection image I4 having the tilt angle of about 40 degrees shown in FIG. 14 can be obtained. Furthermore, in the sixth segment 26 of the main reflection surface 2U, reflection images from the reflection image I3 having the tilt angle of about 20 degrees shown in FIG. 13 to the reflection image I5 having the tilt angle of about 40 degrees shown in FIG. 14 can be obtained. Still furthermore, in the first segment 21, the second segment 22, the seventh segment 27, and the eighth segment 28, of the main reflection surface 2U, reflection images each having a tilt angle of 40 degrees or more can be obtained.

Here, the reflection images from the reflection image I1 having the tilt angle of about 0 degree shown in FIG. 12 to the reflection images 12, 13 each having the tilt angle of about 20 degrees shown in FIG. 13 are reflection images that are suitable to form a light distribution including an oblique cutoff line CL1 of the light distribution pattern LP for low beam. In other words, this is because the reflection images from the reflection image I1 having the tilt angle of about 0 degree to the reflection images 12, 13 each having the tilt angle of about 20 degrees are easily taken along the oblique cutoff line CL1 having a tilt angle of about 15 degrees. On the other hand, reflection images each having a tilt angle of about 20 degrees or more, including the reflection images 14, each having the tilt angle of about 40 degrees shown in FIG. 14, are reflection images that are unsuitable to form the light distribution including the oblique cutoff line CL1 of the light distribution pattern LP for low beam. In other words, if a reflection image having a tilt angle of about 20 degrees or more is taken along the oblique cutoff line CL1 having the tilt angle of about 15 degrees, the resultant light distribution increases in thickness in a vertical direction, resulting in an excessive proximal light distribution (i.e., a light distribution that lowers in distal visibility).

Figure 8:
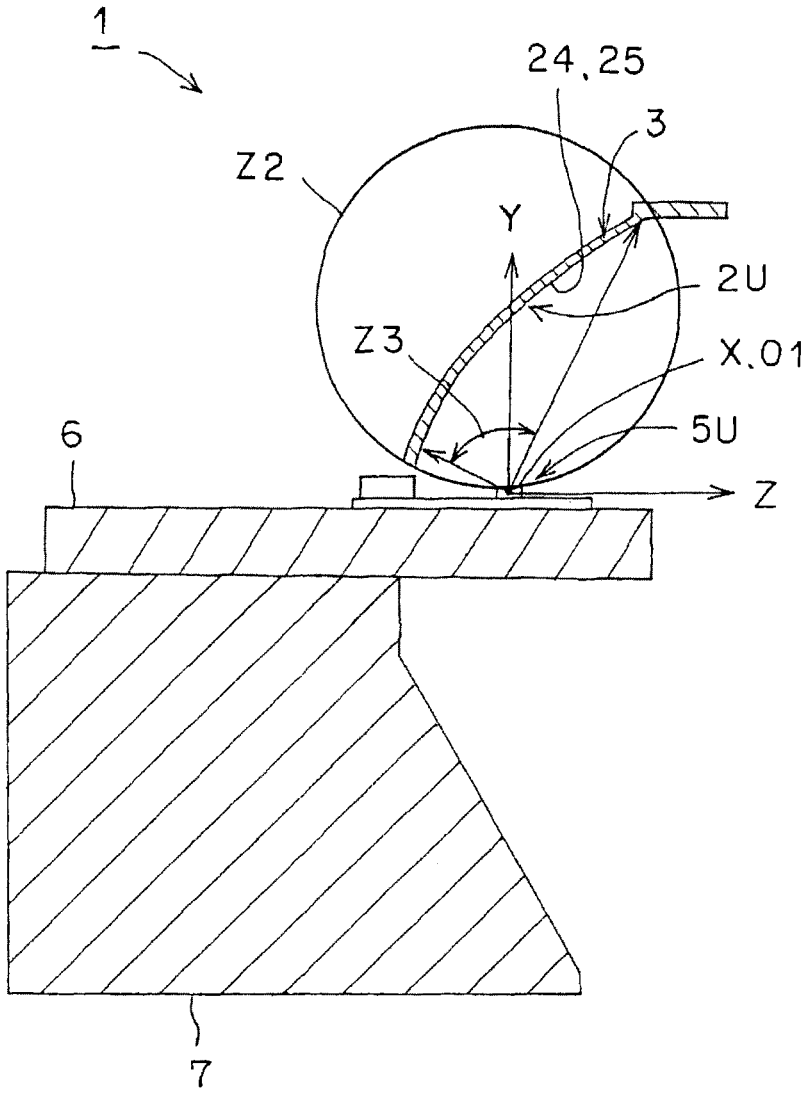
FIG. 8 is a sectional view of the essential portions, taken along the line VIII-VIII in FIG. 7, similarly.

In addition, a light distribution in the oblique cutoff line CL1 is responsible for a distally visible light distribution. Thus, there is a need to form a high luminous intensity zone (a high energy zone) for the light distribution in the oblique cutoff line CL1. Therefore, the fourth segment 24 of the first reflection surface and the fifth segment 25 of the second reflection surface, of the center portion, as shown in FIG. 8, are included in a high energy range Z3 in an energy distribution (Lambertian) Z2 of the light emitting chip 4.

From the foregoing description, the reflection surface that is suitable to form a light distribution in the oblique cutoff line CL1 is determined depending on a relative relationship between a range in which reflection images I1, I2 each having the tilt angle of 20 degrees or less can be obtained among reflection surfaces having parabolic free curved faces and the energy distribution (Lambertian) of the semiconductor-type light source 5U. As a result, the reflection surfaces that are suitable to form a light distribution in the oblique cutoff line CL1, i.e., the fourth segment 24 and the fifth segment 25 are provided in the range Z1 that is within the latitude angle of ∓40 degrees from the center O1 of the light emitting chip 4. These segments are also provided in a high energy range Z3 in the energy distribution (Lambertian) Z2 of the light emitting chip 4, the energy range Z3 being equivalent to a range in which there can be obtained the reflection images I1, I2 of the light emitting chip 4 whose tilt angle is within the tilt angle (about 20 degrees) that can be obtained by adding about 5 degrees to the tilt angle (about 15 degrees) of the oblique cutoff line CL1.

The first reflection surface that is made up of the forth segment 24, as shown in FIG. 15 and FIG. 17, is a reflection surface that is made up of a free curved face adapted to control the reflection images I1, I2 of the light emitting chip 4 to be optically distributed in a range Z4 in the light distribution pattern LP for low beam. This reflection surface is defined so that the reflection images I1, I2 of the light emitting chip 4 do not fly out from the oblique cutoff line CL1 and the horizontal cutoff line CL2. The above reflection surface is also defined so that a part of the reflection images I1, I2 of the light emitting chip 4 substantially comes into contact with the oblique cutoff line CL1 and the horizontal cutoff line CL2.

In addition, the second reflection surface that is made up of the fifth segment 25, as shown in FIG. 16 and FIG. 17, is a reflection surface that is made up of a free curved face for controlling the reflection images I1, I3 of the light emitting chip 4 to be optically distributed in a range Z5 containing the range Z4 in the light distribution pattern LP for low beam. This reflection surface is defined so that: the reflection images I1, I3 of the light emitting chip 4 do not fly out from the oblique cutoff line CL1 and the horizontal cutoff line CL2; and a part of the reflection images of the reflection images I1, I3 of the light emitting chip 4 substantially comes into contact with the oblique cutoff line CL1 and the horizontal cutoff line CL2. In addition, the above reflection surface is defined so that: the density of a group of the reflection images I1, I3 of the light emitting chip 4 is lower than that of a group of the reflection images I1, I2 of the light emitting chip 4, the images having been formed by the first reflection surface that is made up of the fourth segment 24; and the group of the reflection images I1, I3 of the light emitting chip 4 contains that of the reflection images I1, I2 of the light emitting chip 4, the images having been formed by the first reflection surface that is made up of the fourth segment 24. The density of one of the reflection images I1, I2 of the light emitting chip 4 is equal to or substantially equal to that of one of the reflection images I1, I3 of the light emitting chip 4.

Further, the third reflection surface that is made up of the first segment 21, the second segment 22, the third segment 23, the sixth segment 26, the seventh segment 27, and the eighth segment 28 is a reflection surface that is made up of a free curved face that is adapted to control reflection images 14, 15 of the light emitting chip 4 to be optically distributed in a range Z6 containing the ranges Z4, Z5 included in the light distribution pattern LP for low beam. This reflection surface is defined so that the reflection images 14, 15 of the light emitting chip 4 is substantially included in the light distribution pattern LP for low beam. In addition, the above reflection surface is defined so that the density of a group of the reflection images I4, I5 of the light emitting chip 4 is lower than that of the group of the reflection images I1,I2 of the light emitting chip 4, the images having been formed by the first reflection surface that is made up of the fourth segment 24 and that of the group of the reflection images I1, I3 of the light emitting chip 4, the images having been formed by the second reflection chip that is made up of the fifth segment 25. Further, the third reflection surface is defined so that and the group of the reflection images 14, 15 of the light emitting chip 4 contains that of the reflection images I1, I2 of the light emitting chip 4, the images produced by the first reflection surface that is made up of the fourth segment 24 and that of the reflection images I1, I3 of the light emitting chip 4, the image having been formed by the second reflection surface that is made up of the fifth segment 25.

Figure 1:
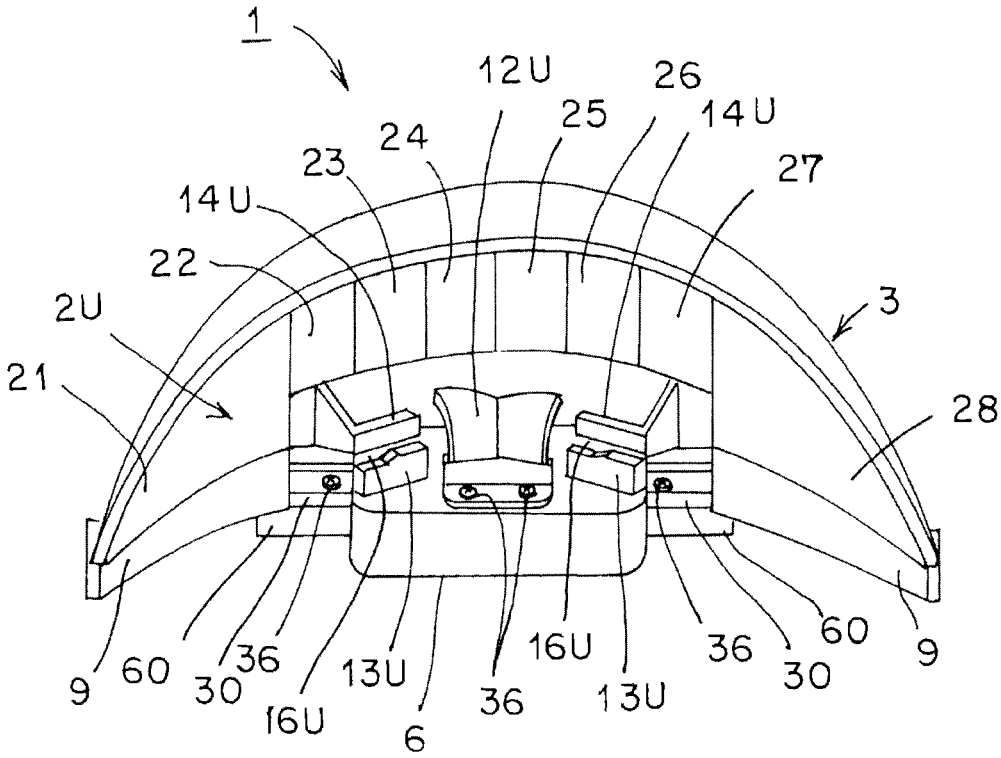
FIG. 1 is a perspective view of essential portions showing a first embodiment of a vehicle headlamp according to the present invention.
Figure 2:
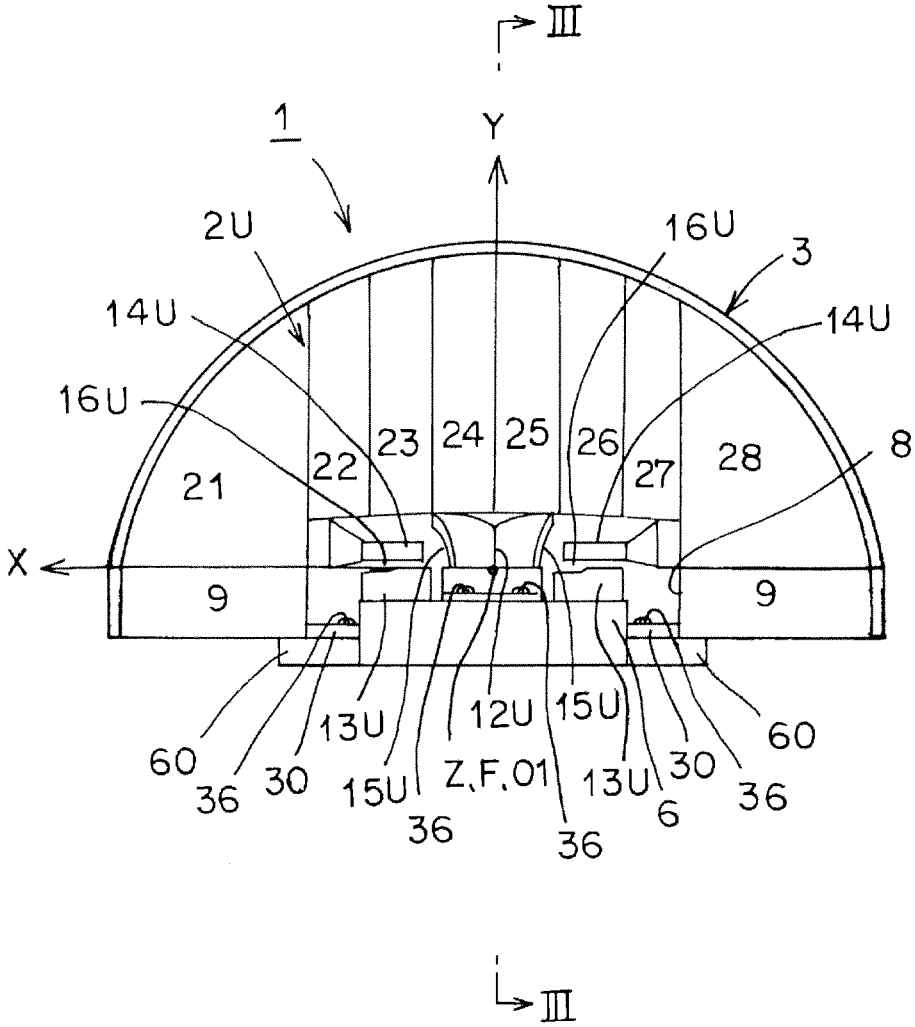
FIG. 2 is a front view showing the essential portions, similarly.
Figure 3:
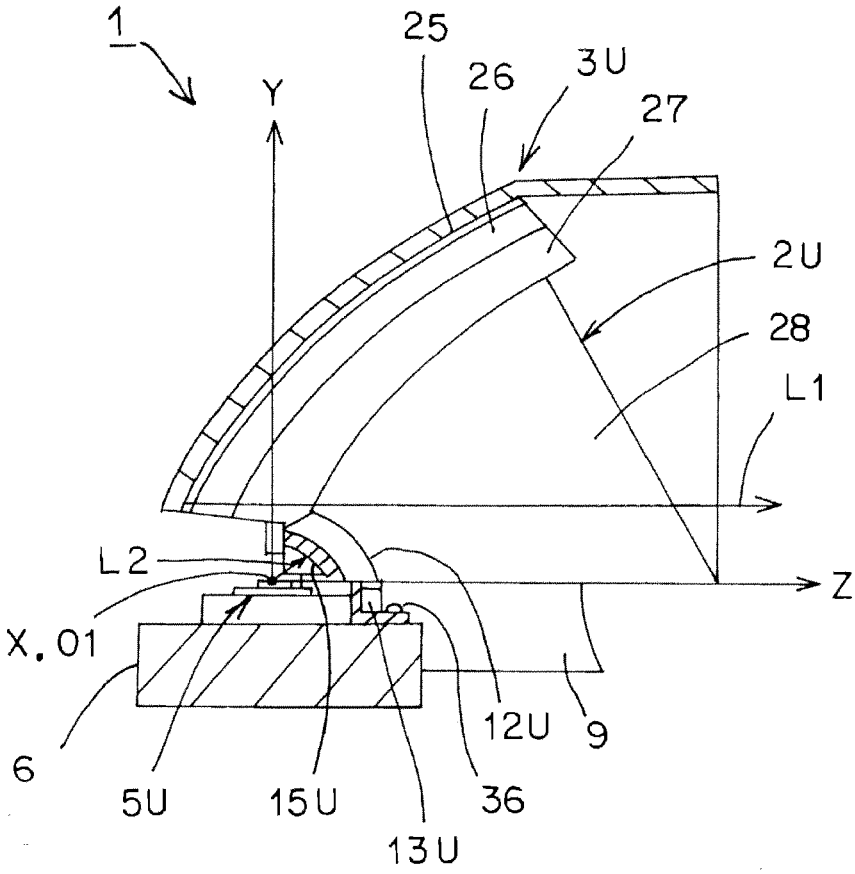
FIG. 3 is a sectional view of the essential portions, taken along the line III-III in FIG. 2, similarly.

One of the light shading members 12U, two of the first shades 13U, 13U, and two of the second shades 14U, 14U are arranged respectively separately, and as shown in FIG. 3, these elements are disposed in a space other than an optical path L1 that is emitted with light from the main reflection surface 2U to a forward direction of a vehicle. One of the light shading members 12U and one of the reflectors 3 are arranged respectively separately.

The light shading member 12U is provided in a range from a forward direction to an obliquely upward direction and from a forward direction to a slightly obliquely bilateral direction with respect to the light emitting chip 4. The light shading member 12U is made up of an optically opaque resin member or the like, for example. The light shading member 12U, as shown in FIG. 3, is a member adapted to shade light L2 that is directly radiated from a light emitting surface of the light emitting chip 4 to the forward direction of the vehicle.

On an inside face of the light shading member 12U, i.e., on a face opposing to the light emitting surface of the light emitting chip 4, there are provided: two of first additional reflection surfaces 15U, 15U that are made up of an elliptical free curved face on which: first reference focal points F1, F1 are positioned at or near a reference focal point F of the upper main reflection surface 2U. In other words, the first reference focal points F1, F1 are shared or substantially shared; second focal points F2, F2 are positioned at or in lower proximity to the horizontal axis X that is defined at both of the left and right sides with respect to the upper semiconductor-type light source 5U, and moreover, that is defined at the first reference focal point F of the upper main reflection surface 2U or at the frontal side more than the first reference focal point F1. The two of the first additional reflection surfaces 15U, 15U that are defined at both of the left and right sides are adapted to converge and reflect the light L2 at the second reference focal points F2, F2 the light L2 having been directly radiated from the light emitting surface of the light emitting chip 4 to the forward direction of the vehicle.

Figure 4:
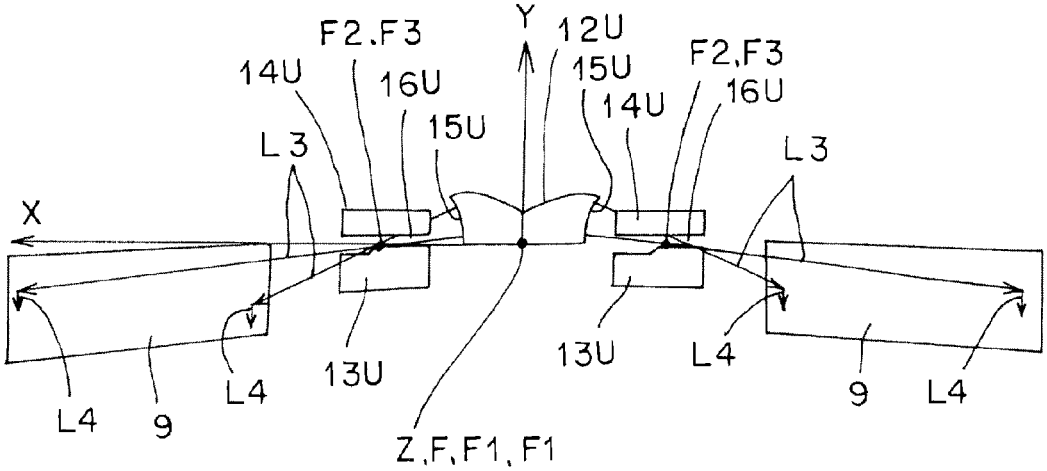
FIG. 4 is an explanatory front view showing an optical path of reflected light from a first additional reflection surface and reflected light from a second additional reflection surface, similarly.
Figure 5:
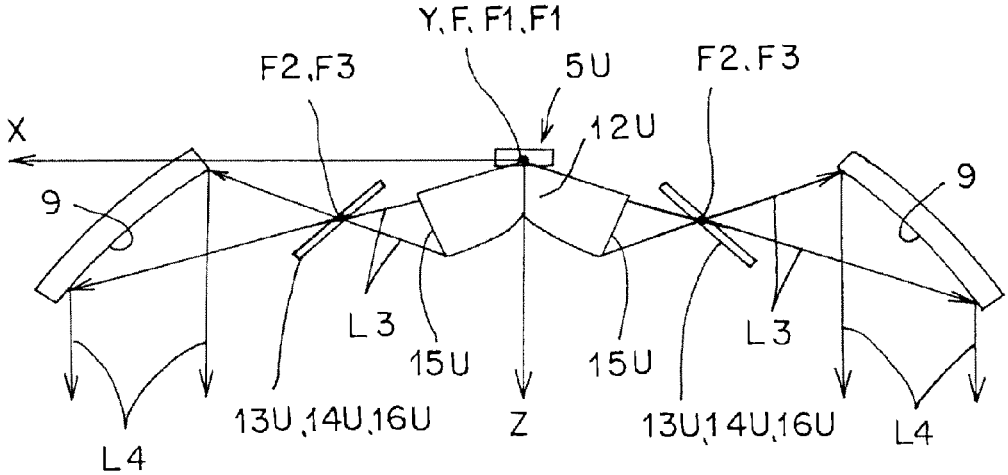
FIG. 5 is an explanatory plan view showing the optical path of the reflected light from the first additional reflection surface and the reflected light from the second additional reflection surface, similarly.
Figure 6:
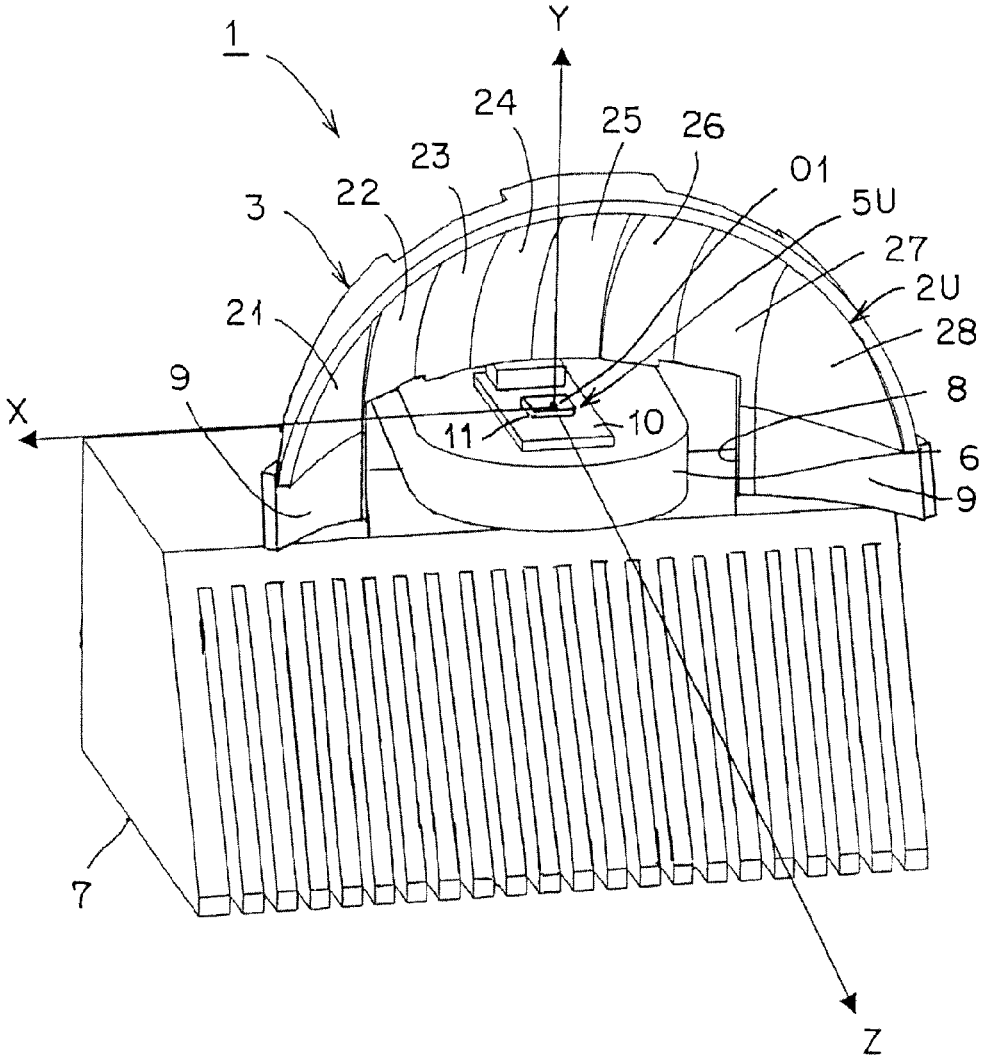
FIG. 6 is a perspective view showing essential portions in a state in which a light shading member, the first additional reflection surface, and at least one shade are removed, similarly.

Among inside (front-side) faces of the reflector 3, on the non-luminous faces 9, 9 that are faces defined at both of the left and right sides of the window portion 8 and defined at the lower part of the upper main reflection surface 2U, i.e., that are sites other than the upper main reflection surface 2U of the reflector 3 and faces that are positioned at both of the left and right sides with respect to the upper semiconductor-type light source 5U that is downward of the upper main reflection surface 2U, there are provided two of the second additional reflection surfaces that are surface that is made up of parabolic free curved faces on which reference focal points F3, F3 are positioned at or near the second reference focal points F2, F2 of the two of the first additional reflection surfaces 15U, 15U, respectively. The two of the second additional reflection surfaces 9, 9 that are defined at both of the left and right sides, as shown in FIG. 4 and FIG. 5, are adapted to reflect the reflected light L3 from the two of the first additional reflection surfaces 15U, 15U and then emit the reflected light L4 to the forward direction of the vehicle as a predetermined additional light distribution pattern, in the embodiment an additional light distribution pattern LP1 having cutoff lines CL1, CL2 (the light distribution pattern enclosed by the dashed line in FIG. 17). While the reflected light L4 in FIG. 4 is indicated by the downward-oriented arrow, the light is actually emitted slightly downward in the forward direction of the vehicle.

The two of the first shades 13U, 13U and the two of the second shades 14U, 14U are disposed between the two of the first additional reflection surfaces 15U, 15U (the light shading member 12U) and the two of the second additional reflection surfaces 9, 9. In addition, these shades are also disposed at or near the second reference focal points F2, F2 of the two of the first additional reflection surfaces 15U, 15U. Further, the above shades are disposed at and near the reference focal points F3, F3 of the two of the second additional reflection surfaces 9, 9. The two of the first shades 13U, 13U that are defined at both of the left and right sides and the two of the second shades 14U, 14U that are defined at both of the left and right sides are made up of an optically opaque resin member or the like, for example. In the two of the first shades 13U, 13U and the two of the second shades 14U, 14U, two openings 16U, 16U are provided for passing the reflected light L3 from the two of the first additional reflection surfaces 15U, 15U to form the additional light distribution pattern LP1 having the cutoff lines CL1, CL2, respectively. Upper edges of the two of the openings 16U, 16U that are defined at both of the left and right sides, i.e., lower edges of the two of the second shades 14U, 14U form a horizontal line. The lower edges of the two of the openings 16U, 16U, i.e., the upper edges of the two of the first shades 13U, 13U form a step-difference horizon in which a right-side halve is lowered by one stage with respect to a left-side halve.

The additional light distribution pattern LP1 is controlled to be optically distributed in a range containing a part of the range Z4 and the range Z5 in the light distribution pattern LP for low beam. The cutoff lines CL1, CL2 of the additional light distribution pattern LP1 coincide with the cutoff lines CL1, CL2 of the light distribution pattern LP for low beam.

The vehicle headlamp 1 in the embodiment is made up of the above-described constituent elements. Hereinafter, a functional description will be given.

First, a light emitting chip 4 of an upper semiconductor-type light source 5U of a vehicle headlamp 1 is illuminated to emit light. As shown in FIG. 3, light is then radiated from an upward light emitting surface of the light emitting chip 4 of the upper semiconductor-type light source 5U. A part of the light (the light in a range Z3 of high energy in an energy distribution (Lambertian) Z2 of the light emitting chip 4) is reflected by means of an upper reflection surface 2U of a reflector 3. The reflected light L1 is emitted to a forward direction of a vehicle as a light distribution pattern LP for low beam, shown in FIG. 17.

In other words, the reflected light L1 from a first reflection surface that is made up of a fourth segment 24 of the main reflection surface 2U is controlled to be optically distributed in a range Z4 in the light distribution pattern LP for low beam. The above reflected light L1 is controlled to be optically distributed so that: reflection images I1, I2 of the light emitting chip 4 does not fly out from an oblique cutoff lines CL1 and a horizontal cutoff line CL2; and a part of the reflection images I1, I2 of the light emitting chip 4 substantially come into contact with the oblique cutoff line CL1 and the horizontal cutoff line CL2.

In addition, the reflected light L2 from a second reflection surface that is made up of a fifth segment 25 of the main reflection surface 2U is controlled to be optically distributed in a range Z5 containing the range Z4 included in the light distribution pattern LP for low beam. The above reflected light L2 is controlled to be optically distributed so that: reflection images I1, I3 of the light emitting chip 4 do not fly out from the oblique cutoff line CL1 and the horizontal cutoff line CL2; and a part of the reflection images I1, I3 of the light emitting chip 4 substantially come into contact with the oblique cutoff line CL1 and the horizontal cutoff line CL2. In addition, the above reflected light 12 is also controlled to be optically distributed so that: the density of the group of the reflection images I1, I3 of the light emitting chip 4 is lower than that of a group of the reflection images I1, I2 of the light emitting chip, the images having been formed by the first reflection surface that is made up of the fourth segment 24; and the group of the reflection images I1, I3 of the light emitting chip 4 contains that of the reflection images I1, I2 of the light emitting chip 4, the images having been formed by the first reflection surface that is made up of the fourth segment 24.

Further, the reflected light L1 from a third reflection surface that is made up of a first segment 21, a second segment 22, a third segment 23, a sixth segment 26, a seventh segment 27, and an eighth segment 28, of the main reflection surface 2U, is controlled to be optically distributed in a range Z6 containing the ranges Z4, Z5 included in the light distribution pattern LP for low beam. The above reflected light L1 is controlled to be optically distributed so that reflection images 14, 15 of the light emitting chip 4 are substantially included in the light distribution pattern LP for low beam. The above reflected light L1 is also controlled to be optically distributed so that the density of a group of the reflection images I4, I5 of the light emitting chip 4 is lower than that of the group of the reflection images I1, I2 of the light emitting chip 4, the images having been formed by the first reflection surface that is made up of the fourth segment 24, and that of the group of the reflection images I1, I3 of the light emitting chip 4, the images having been formed by the second reflection surface that is made up of the fifth segment 25. In addition, the above reflected light L1 is controlled to be optically distributed so that the group of the reflection images I4, I5 of the light emitting chip contains that of the reflection images I1, I2 of the light emitting chip, the images having been formed by the first reflection surface that is made up of the fourth segment 24, and that of the reflection images I1, I3 of the light emitting chip 4, the images having been formed by the second reflection surface that is made up of the fifth segment 25.

In the manner as described above, the light distribution pattern LP for low beam, shown in FIG. 17, is emitted to a forward direction of a vehicle.

On the other hand, as shown in FIG. 3 to FIG. 5, light L2 directly radiated to a forward direction of a vehicle from an upward light emitting surface of the light emitting chip 4 of the upper semiconductor-type light source 5U is adapted to converge and to be reflected by means of two of the first additional reflection surfaces 15U, 15U of the light shading member 12U at the second reference focal point F2, F2 side of the two of the first additional reflection surfaces 15U, 15U that are defined at both of the left and right sides with respect to the upper semiconductor light source 5U. In other words, the above radiated light L2 is adapted to converge and to be reflected at a horizontal axis X or at a site which is slightly lower than the horizontal axis X and at the front side more than a reference focal point F of the upper reflection surface 2U and the first reference focal point F1, F1 of the first additional reflection surface 15U, 15U, respectively. The reflected light L3 is adapted to converge at two of the second reference focal points F2, F2 of the first additional reflection surface 15U, 15U and radiate (scatter) from the second reference focal points F2, F2 of the two of the first additional reflection surfaces 15U, 15U. At this time, the reflected light L3 passes through two of openings 16U, 161U between two of the first shades 13U, 13U and two of the second shades 14U, 14U. The resulting light is then reflected as an additional light distribution pattern LP1 having the cutoff lines CL1, CL2, by means of two of the second additional reflection surfaces 9, 9 that are defined at both of the left and right sides with respect to the upper semiconductor-type light source 5U.

Reflected light L4 after reflected by the two of the second additional reflection surface 9, 9 is radiated to a forward direction of a vehicle as an additional light distribution pattern LP1 having the cutoff lines CL1, CL2. The additional light distribution pattern LP1, as indicated by the light distribution pattern enclosed in the dashed line in FIG. 17, is controlled to be optically distributed in a range containing a part of the range Z4 and the range Z5 in the light distribution pattern LP for low beam. The cutoff lines CL1, CL2 of the additional light distribution pattern LP1 coincide with the cutoff line CL1, CL2 of the light distribution pattern LP for low beam.

The vehicle headlamp 1 in the embodiment is made up of the above-described constituent elements and functions. Hereinafter, an advantageous effect of this vehicle headlamp will be described.

According to the vehicle headlamp 1 in the first embodiment, as described previously, when the light emitting chip 4 of the upper semiconductor-type light source 5U is illuminated to emit light, a part of the light radiated from the light emitting chip is reflected by means of the upper reflection surface 2U. The reflected light L1 is emitted to a forward direction of a vehicle as a predetermined light distribution pattern, i.e., the light distribution pattern LP for low beam, the pattern having the cutoff lines CL1, CL2 (hereinafter, referred to as a "predetermined light distribution pattern LP for low beam). In this manner, the vehicle headlamp 1 in the first embodiment can form the predetermined light distribution pattern LP for low beam by means of the upper main reflection surface 2U.

On the other hand, according to the vehicle headlamp 1 in the first embodiment, light L2 directly radiated from the light emitting chip 4 of the upper semiconductor-type light source 5U to the forward direction of the vehicle is reflected on two of the first additional reflection surfaces 15U, 15U that are defined at both of the left and right sides. The light L2 is also reflected at a horizontal axis X that is defined at both of the left and right sides with respect to the upper semiconductor-type light source 5U or at a site which is slightly lower than the horizontal axis X. The light L2 is also reflected at the front side more than the reference focal point F of the upper reflection surface 2U and the first reference focal points F1, F1 of the first additional reflection surfaces 15U, 15U. The reflected light L3 is reflected by means of two of the second additional reflection surfaces 9, 9 that are defined at both of the left and right sides downward of the upper main reflection surface 2U. The reflected light L4 is emitted to the forward direction of the vehicle as an additional light distribution pattern LP1 having the predetermined additional light distribution pattern, i.e., the cutoff lines CL1, CL2 (referred to as a "predetermined additional light distribution pattern LP1"). In this manner, according to the vehicle headlamp 1 in the first embodiment, even without providing an opening at the light shading member 12U, the light L2 directly radiated from the light emitting chip 4 to the forward direction of the vehicle is reflected onto the second additional reflection surfaces 9, 9 side by means of the first additional reflection surfaces 15U, 15U that are provided at the light shading member 12U, enabling the reflected light to be emitted to the forward direction of the vehicle as the predetermined additional light distribution pattern LP1. As a result, according to the vehicle headlamp 1 in the first embodiment, the light L2 directly radiated from the light emitting chip 4 of the upper semiconductor-type light source 5U to the forward direction of the vehicle is shaded more reliably by means of the light shading member 12U having two of the first additional reflection surfaces 15U, 15U. Therefore, the light L2 directly radiated from the light emitting chip 4 of the upper semiconductor-type light source 5U to the forward direction of the vehicle does not leak to the outside.

Moreover, according to the vehicle headlamp 1 in the first embodiment, the light shading member 12U having the two of the first additional reflection surfaces 15U, 15U is disposed in a space other than an optical path L1 which is emitted with light at least from the upper main reflection surface 2U to the forward direction of the vehicle. Therefore, the light shading member 12U having the two of the first additional reflection surfaces 15U, 15U does not interfere with the optical path L1 of the predetermined light distribution pattern LP for low beam, emitted from the upper main reflection surface 2U to the forward direction of the vehicle. As a result, the vehicle headlamp in the first embodiment can efficiently utilize almost all of the reflected light L1 from the upper main reflection surface 2U as the predetermined light distribution pattern LP for low beam without being shaded by the light shading member 12U having the two of the first additional reflection surfaces 15U, 15U. In addition, a failure such as partial lowering of light quantity (luminous intensity, intensity of illumination) in the predetermined light distribution pattern LP for low beam by means of the light shading member 12U having the two of the first additional reflection surfaces 15U, 15U is unlikely to occur. In other words, even if a part of the light shading member 12U is convex in the optical path L1 that is emitted with light from the upper main reflection surface 2U to the forward direction of the vehicle, the above-described failure is unlikely to occur.

Furthermore, according to the vehicle headlamp 1 in the first embodiment, two of the second additional reflection surfaces 9, 9 are provided at sites other than the upper main reflection surface 2U of the reflector 3 and at both of the left and right sides downward of the upper main reflection surface 2U. Therefore, a part of the upper main reflection surface 2U is not eroded by the two of the second additional reflection surface 9, 9. As a result, the vehicle headlamp 1 in the first embodiment can maintain the light quantity (luminous intensity, intensity of illumination) of the predetermined light distribution pattern LP for low beam, the pattern being formed by means of the existing upper main reflection surface 2U, whereas invalid light L2 from the light emitting chip 4 of the upper semiconductor-type light source 5U is efficiently utilized by means of two of the first additional reflection surfaces 15U, 15U and two of the second additional reflection surfaces 9, 9, respective ones of which are additionally provided. Therefore, the light quantity (luminous intensity, intensity of illumination) of the predetermined additional light distribution pattern LP1 can be efficiently utilized with respect to the light quantity (luminous intensity, intensity of illumination) of the predetermined light distribution pattern LP for low beam.

In addition, according to the vehicle headlamp 1 in the first embodiment, a predetermined light distribution pattern LP for low beam is formed by means of the upper main reflection surface 2U, whereas a predetermined additional light distribution pattern LP1 is formed by means of two shades defined at both of the left and right sides, i.e., by means of two of the first shades 13U, 13U and two of the second shades 14U, 14U. As a result, the vehicle headlamp 1 in the first embodiment can easily and reliably obtain light distribution patterns LP, LP1 having cutoff lines CL1, CL2 whose light quantity (luminous intensity, intensity of illumination) is increased, by means of the predetermined light distribution pattern LP for low beam and the predetermined light distribution pattern LP1.

Moreover, according to the vehicle headlamp 1 in the first embodiment, two of the first shades 13U, 13U that are defined at both of the left and light sides and two of the second shades 14U, 14U that are defined at both of the left and right sides are disposed in a space other than the optical path L1 that is emitted with light from the upper main reflection surface 2U to the forward direction of the vehicle and between two of the first additional reflection surfaces 15U, 15U that are defined at both of the left and right sides and two of the second additional reflection surfaces 9, 9 that are defined at both of the left and right sides. These shades are disposed so that two of the first shades 13U, 13U and two of the second shades 14U, 14U do not interfere with the main light distribution pattern that is emitted from the upper main reflection surface 2U to the forward direction of the vehicle. In other words, the above shades are disposed so as not to interfere with the optical path L1 of the light distribution pattern LP for low beam, the pattern having the cutoff lines CL1, CL2. As a result, the vehicle headlamp 1 in the first embodiment can efficiently utilize almost all of the reflected light L1 from the upper main reflection surface 2U as the predetermined light distribution pattern LP for low beam without being shaded by two of the first shades 13U, 13U and two of the second shades 14U, 14U. In addition, a failure such as partial lowering of light quantity (luminous intensity, intensity of illumination) in the predetermined light distribution pattern LP for low beam by means of two of the first shades 13U, 13U and two of the second shades 14U, 14U does not occur.

Further, according to the vehicle headlamp 1 in the first embodiment, the first additional reflection surfaces 15U, 15U are made up of two elliptical free curved faces that are defined at both of the left and right sides; the second additional reflection surfaces 9, 9 are made up of two parabolic free curved faces that are defined at both of the left and right sides; and the at least one shade is made up of two of the first shades 13U, 13U that are defined at both of the left and right sides and two of the second shades 14U, 14U that are defined at both of the left and right sides. Therefore, the light L1 directly emitted from the light emitting chip 4 of the upper semiconductor-type light source 5U can be emitted to the forward direction of the vehicle as the predetermined additional light distribution pattern LP1 by means of: two of the first additional reflection surfaces 15U, 15U; two of the second additional reflection surfaces 9, 9; two of the first shades 13U, 13U; and two of the second shades 14U, 14U. Further, the light L2 emitted from the upper semiconductor-type light source 5U can be utilized further efficiently and reliably in comparison with one of the first additional reflection surfaces and one of the second additional reflection surfaces.

Moreover, according to the vehicle headlamp 1 in the first embodiment, two of the first shades 13U, 13U and two of the second shades 14U, 14U are disposed between two of the first additional reflection surfaces 15U, 15U and two of the second additional reflection surfaces 9, 9 and at or near the second reference focal points F2, F2 of two of the first additional reference surfaces 15U, 15U. As a result, according to the vehicle headlamp 1 in the first embodiment, the reflected light L3 that converges at the second reference focal points F2, F2 of two of the first additional reflection surfaces 15U, 15U or the reflected light L3 radiated (diffused) from the second reference focal points F2, F2 of two of the first additional reflection surfaces 15U, 15U can be controlled to be optically distributed precisely, easily, and reliably as a predetermined additional light distribution pattern LP1 by means of two of the first shades 13U, 13U, two of the second shades 14U, 14U, and two openings 16U, 16U that are disposed at or near the second reference focal points F2, F2 of two of the first additional reference surfaces 15U, 15U.

In addition, according to the vehicle headlamp 1 in the first embodiment, the reflector 3 at which the upper reflection surface 2U and the second additional reflection surfaces 9, 9 are provided and the light shading member 12U at which the first additional reflection surfaces 15U, 15U are provided are arranged respectively separately, thus simplifying a structure of the reflector 3 at which the upper reflection surface 2U and the second additional reflection surfaces 9, 9 are provided and a structure of the light shading member 12U at which the first additional reflection surfaces 15U, 15U are provided. As a result, the vehicle headlamp 1 in the first embodiment can lower manufacturing cost, i.e., can reduce manufacturing cost.

Further, the vehicle headlamp 1 can efficiently utilize the light from the upper semiconductor-type light source 5U, thus enabling downsizing of the constituent elements of lamp unit, i.e. reference numerals 3, 5U, 6, 7, 12U, 13U, 13U, 14U, 14U and reduction of manufacturing cost.

Moreover, according to the vehicle headlamp 1 in the first embodiment, the first shades 13U, 13U, the second shades 14U, 14U, the reflector 3, and the light shading member 12U are arranged respectively separately, thus simplifying a structure of a respective one of the first shades 13U, 13U, the second shades 14U, 14U, the reflector 3, and the light shading member 12U. Still moreover, according to the vehicle headlamp in the first embodiment, there are arranged respectively separately: the first shades 13U, 13U and the second shades 14U, 14U that are adapted to shade light; the reflector 3 of the upper main reflection surfaces 15U, 15U and the second additional reflection surfaces 9, 9 that are adapted to reflect light; and the light shading member 12U of the first additional reflection surfaces 15U, 15U that are adapted to reflect light. Therefore, while a light shading process is applied to the first shades 13U, 13U and the second shades 14U, 14U, a light reflection process can be applied to the reflector 3 and the light shading member 12U separately, thus simplifying the light shading process and the light reflection process. As a result, the vehicle headlamp 1 in the first embodiment can lower manufacturing cost because its structure, its light shading process, and its light reflection process are simplified.

In the first embodiment, two of the first additional reflection surfaces 15U, 15U are provided at the left and right of one light shading member 12U. In addition, two of the second additional reflection surfaces 9, 9 are provided at the left and right of one reflector 3. Further, two of the first shades 13U, 13U and two of the second shades 14U, 14U are provided at the left and right between the first additional reference surfaces 15U, 15U and the second additional reflection surfaces 9, 9. However, in the present invention, one of the first additional reflection surfaces, one of the second additional surfaces, and one of the shades, i.e., one of the first shades and one of the second shades may be provided at either of the left and right sides. In addition, the first embodiment focuses on the upside lamp unit, wherein the constituent elements of the lamp unit, designated by reference numerals 3, 5U, 6, 7, 12U, 13U, 13U, 14U, 14U are provided upper than the horizontal axis X. However, in the present invention, there may be the downside lamp unit, wherein the above constituent elements of the lamp unit are provided lower than the horizontal axis.

Second Embodiment

FIG. 18 to FIG. 25 show a vehicle headlamp according to a second embodiment of the present invention. Hereinafter, the vehicle headlamp in the second embodiment will be described. In the figures, like constituent elements shown in FIG. 1 to FIG. 17 are designated by like reference numerals. Here, in light shading members; first shades; second shades; first additional reflection surfaces; and openings, the constituent elements of the upside unit are designated by reference numerals 12U, 13U, 14U, 15U, 16U and on the other hand, the constituent elements of the downside unit are designated by reference numerals 12D, 13D, 14D, 15D, 16D.

According to the vehicle headlamp 100 in the second embodiment, a reflector 300, there are arranged respectively separately an upper semiconductor-type light source 5U, a lower semiconductor-type light source 5D, a holder 6, a heat sink member 7, an upper light shading member 12U, a lower light shading member 12D, two pairs of upper shades 13U, 13U, 14U, 14U, and two pairs of lower shades 13D, 13D, 14D, 14D.

According to the vehicle headlamp 100 in the second embodiment, the constituent elements of the downside unit in which the light emitting surface of a light emitting chip 4 is oriented downward in a vertical Y-axis direction (a lower reflection surface 2D and a lower semiconductor-type light source 5D) are disposed so as to be established in a point-symmetrical state while a point O is defined as a center with respect to the constituent elements of the upside unit in which the light emitting surface of the light emitting chip 4 is oriented downward in the vertical Y-axis direction (in other words, the upper reflection surface 2U and the upper semiconductor-type light source 5U of the first embodiment). A reflection surface design of each of the segments 21 to 28 of the upper reflection surface 2U and a reflection surface design of each of the segments 21 to 28 of the lower reflection surface 2D are not in a mere point-symmetry (not in an inverted state).

In addition, two of the upper first shades 13U, 13U and two of the upper second shades 14U, 14U that are defined at both of the left and light sides; and two of the lower first shades 13D, 13D and two of the lower second shades 14D, 14D at the both of the left and right sides are not in a mere point-symmetry (not in an inverted state). In other words, upper openings 16U, 16U between two of the upper first shades 13U, 13U and two of the upper second shades 14U, 14U that are defined at both of the left and right sides are moved as these constituent elements are provided in parallel from an upper side to a lower side, thereby forming lower openings 16D, 16D between two of the lower first shades 13D, 13D and two of the lower second shades 14D, 14D that are defined at both of the left and right sides. Therefore, upper edges of two of the lower openings 16D, 16D, i.e., lower edges of two of the first shades 13D, 13D form a horizontal line. Lower edges of two of the lower openings 16D, 16D, i.e., upper edges of two of the lower second shades 14D, 14D form a step-difference horizon in which a right-side halve is lowered by one stage with respect to a left-side halve.

In FIG. 18 to FIG. 22, a horizontal axis X, a vertical axis Y, and a reference optical axis Z, as in the first embodiment, constitute an orthogonal coordinate (an X-Y-Z orthogonal coordinate system) while a center O1 of a light emitting chip 4 is defined as an origin. The horizontal axis X, the vertical axis Y, and the reference optical axis Z, are as in the first embodiment in the case of the constituent elements of the upside unit, designated by reference numerals 2U, 5U, 12U, 13U, 13U, 14U, 14U. In the case of the constituent elements of the downside unit, designated by reference numerals 2D, 5D, 12D, 13D, 13D, 14D, 14D in the horizontal axis X, the left side corresponds to a positive direction and the right side corresponds to a negative direction. In the vertical axis Y, the lower side corresponds to a positive direction and the upper side corresponds to a negative direction. In the reference optical axis, the front side corresponds to a positive direction and the rear side corresponds to a negative direction.

A reflector 300 is made up of an optically opaque resin member, for example. The reflector 300 forms the shape of a substantially rotational parabolic face while an axis passing through a center point O is defined as a rotary axis. A front side of the reflector 300 is opened in a substantially circular shape. The size of a substantially circular opening at the front side of the reflector 300 is equal to or smaller than about 100 mm in diameter. On the other hand, a rear side of the reflector 300 is closed. The window portion 8 that is formed in a substantially transversely elongated rectangle is provided at an intermediate part of the closed portion of the reflector 300. The holder 6 is inserted into the window portion 8 of the reflector 300.

Among the inside (front-side) faces of the closed portion of the reflector 300, the upper main reflection surface 2U is provided on an upper face of the window portion 8. The upper main reflection surface 2U made up of a parabolic free curved face (a NURBS curved face) has a reference focal point (a pseudo focal point) F and a reference optical axis (a pseudo optical axis) Z. Among the inside (front-side) faces of the closed portion of the reflector 300, faces that are defined at both of the left and right sides of the window portion 8 and that are defined at the lower portion of the upper main reflection surface 2U are non-luminous faces which the light radiated from the light emitting surface of the light emitting chip 4 of the lower semiconductor-type light source 5D does not reach, i.e., non-luminous faces 9, 9.

Among the inside (front-side) faces of the closed portion of the reflector 300, the upper main reflection surface 2U is provided on an upper face of the window portion 8. The upper main reflection surface 2U made up of a parabolic free curved face (a NURBS curved face) has a reference focal point (a pseudo focal point) F and a reference optical axis (a pseudo optical axis) Z. Among the inside (front-side) faces of the closed portion of the reflector 300, faces that are defined at both of the left and right sides of the window portion 8 and that are defined at the upper portion of the lower main reflection surface 2D are non-luminous faces which the light radiated from the light emitting surface of the light emitting chip 4 of the lower semiconductor-type light source 5D does not reach, i.e., non-luminous faces 9, 9.

In addition, the vehicle headlamp 100 in the second embodiment provides the constituent elements of the upside unit, i.e., one light shading member 12D; two of the first shades 13D, 13D that are defined at both of the left and right sides; two of the second shades 14D, 14D that are defined at both of the left and right sides; two of the first additional reflection surfaces 15D, 15D that are defined at both of the left and right sides; and two of the openings 16D, 16D that are defined at both of the left and right sides, as is the case with the constituent elements of the upside unit of the first embodiment, i.e., one light shading member 12U; two of the first shades 13U, 13U that are defined at both of the left and right sides; two of the second shades 14U, 14U that are defined at both of the left and right sides; two of the first additional reflection surfaces 15U, 15U that are defined at both of the left and right sides; and two of the openings 16U, 16U that are defined at both of the left and right sides.

In other words, the constituent elements of the downside unit, i.e., the light shading member 12D, the first shades 13D, 13D, the second shades 14D, 14D, the first additional reflection surfaces 15D, 15D, and the openings 16D, 16D are disposed so as to be established in a point-symmetrical state while the point O is defined as a center with respect to the constituent elements of the upside unit, i.e., the light shading member 12U, the first shades 13U, 13U, the second shades 14U, 14U, the first additional reflection surface 15U, 15U, and the openings 16U, 16U.

The first reference focal points F1, F1 of two of the first additional reflection surfaces 15D, 15D of the downside unit are positioned at or near the reference focal point F of the lower main reflection surface 2D and is shared or substantially shared. In addition, the second reference focal points F2, F2 of two of the first additional reflection surfaces 15D, 15D of the downside unit are positioned at the horizontal axis X or in upward proximity of the horizontal axis X. These focal points are also positioned at both of the left and right sides with respect to the lower semiconductor-type light source 5D. Moreover, the above focal points are positioned at the front side more than the reference focal point F of the lower main reflection surface 2D or the first reference focal points F1, F1.

Figure 19:
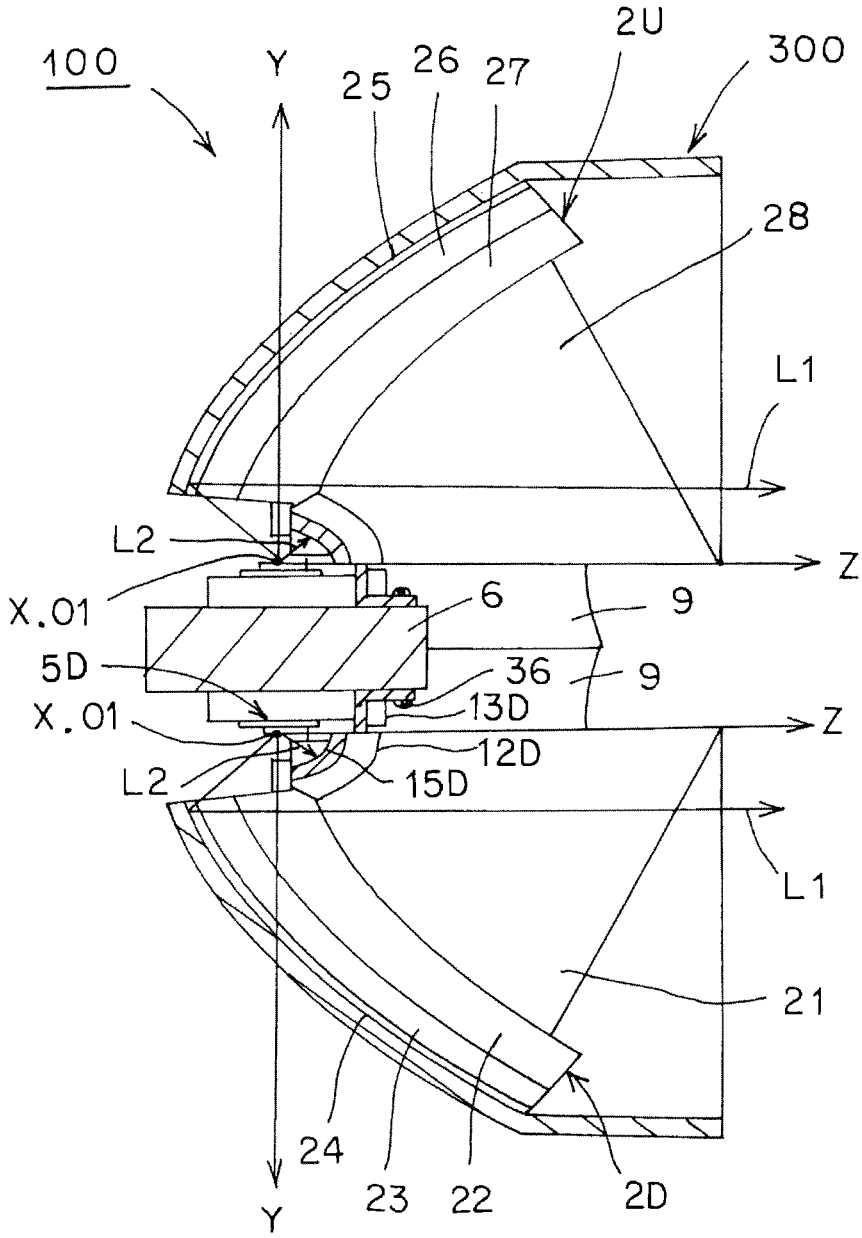
FIG. 19 is a sectional view of the essential portions taken along the line XIX-XIX in FIG. 18, similarly.
Figure 20:
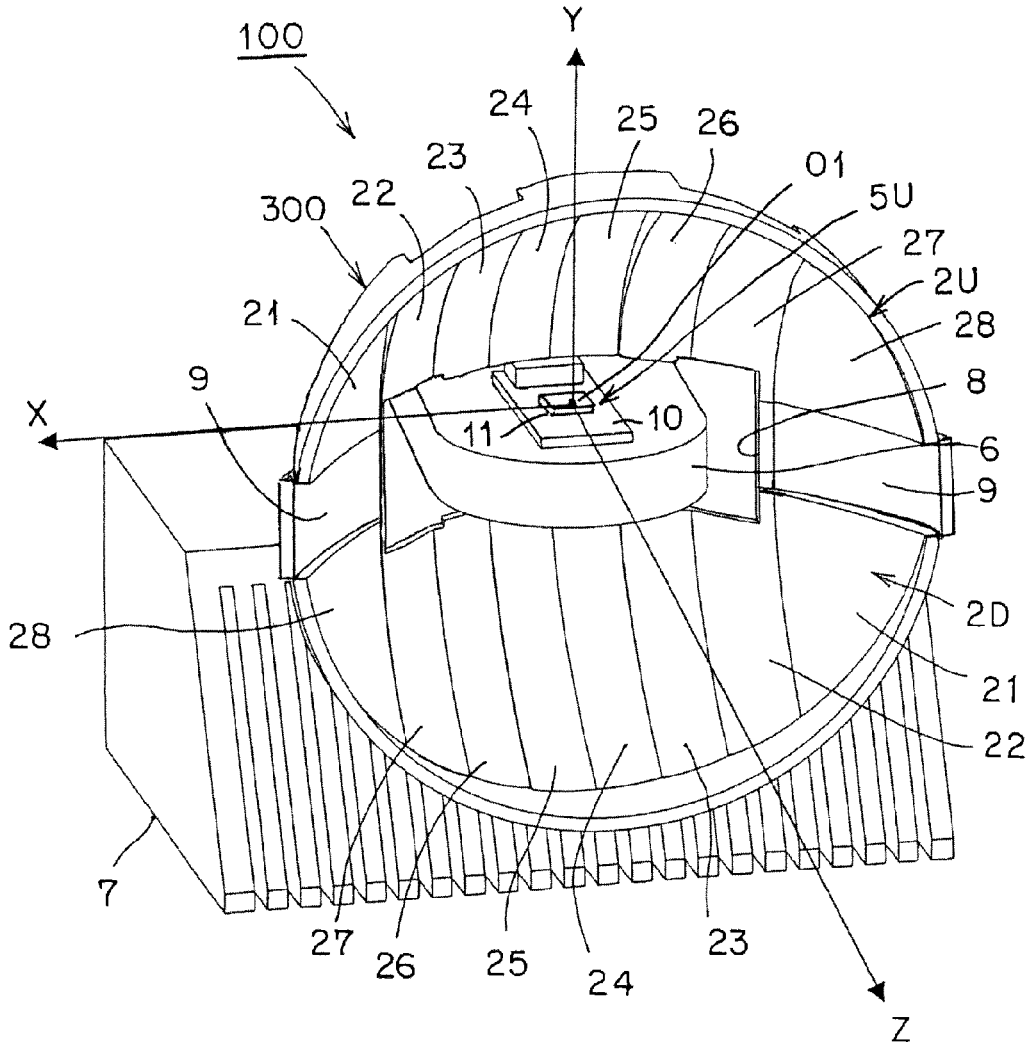
FIG. 20 is a perspective view showing essential portions in a state in which a light shading member, a first additional reflection surface, and at least one shade are removed, similarly.
Figure 21:
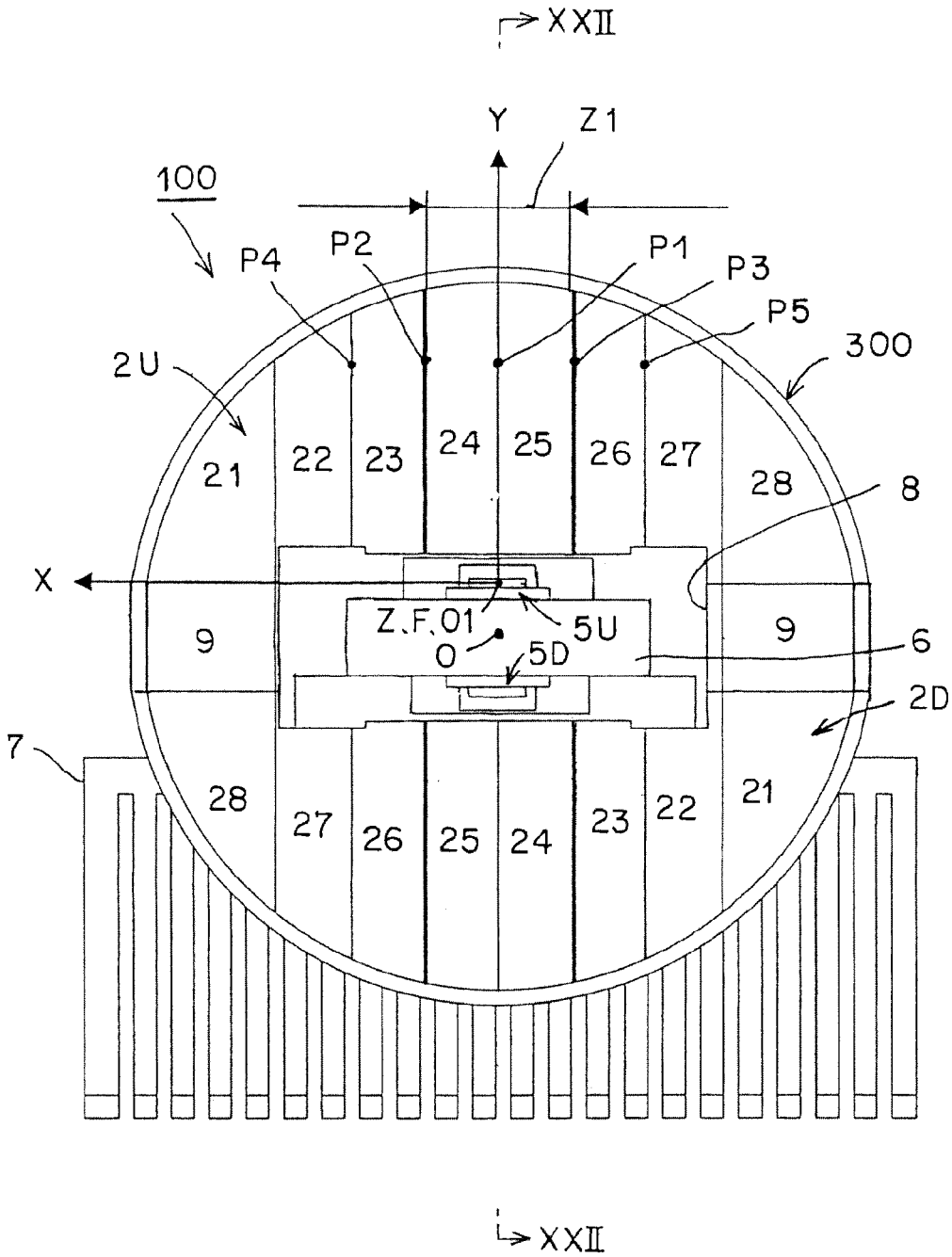
FIG. 21 is a front view showing the essential portions in the state in which the light shading member, the first additional reflection surface, and the shade are removed, similarly.
Figure 22:
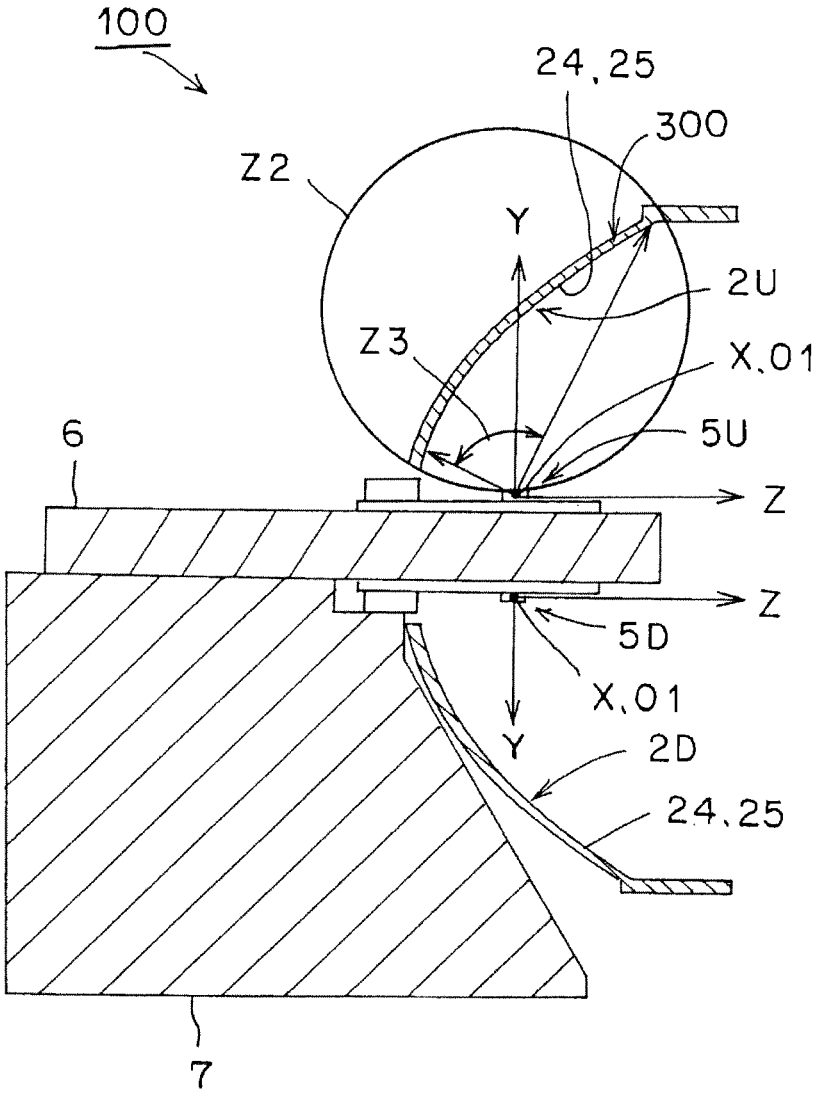
FIG. 22 is a sectional view of the essential portions, taken along the line XXII-XXII in FIG. 21, similarly.

One upper light shading member 12U, two of the upper first shades 13U, 13U, and two of the upper second shades 14U, 14U are arranged respectively separately, and as shown in FIG. 19, these constituent elements are disposed in a space other than an optical path L1 which is emitted with light from the upper reflection surface 2U to a forward direction of a vehicle. Similarly, one lower light shading member 12D, two of the lower first shades 13D, 13D, and two of the lower second shades 14D, 14D are arranged respectively separately, and as shown in FIG. 19, these constituent elements are disposed in a space other than the optical path L1 which is emitted with light from the lower main reflection surface 2D to the forward direction of the vehicle. One lower light shading member 12U, one upper light shading member 12D, the reflector 300 are arranged respectively separately.

A lamp unit is configured with: the reflector 300, the upper semiconductor-type light source 5U, the lower semiconductor-type light source 5D, the holder 6; the head sink member 7; the upper light shading member 12D; the lower light shading member 12D; the upper first shades 13U, 13U; the lower first shades 13D, 13D; the upper shades 14U, 14U; and the lower first shades 14D, 14D.

In other words, the reflector 300 is fixed and held by means of the holder 6. Hereinafter, a further detailed description will be given. Fixing portions 30 and 60 are provided respectively integrally at each of the left and right sides of the window portion 8 of the reflector 300 and at each of the left and right sides of the holder 6. The fixing portion 30 of the reflector 300 is fixed and held by means of a screw 36 of the fixing portion 60 of the holder 6 or by means of a fixing member (an elastic engagement between an elastic hook, a so called patching engagement).

The upper semiconductor-type light source 5U and the lower semiconductor-type light source 5D are fixed and held at an upper fixing face and a lower fixing face of the holder 6 by means of a fixing member (a screw or an elastic engagement between an elastic hook and an engagement portion, a so called patching engagement), although not shown. The holder 6 is fixed and held on an upper fixing face of the heat sink member 7 (a screw or an elastic engagement between an elastic hook and an engagement portion, a so called patching engagement), although not shown. The upper light shading member 12U and the lower light shading member 12D are fixed at a center of the upper fixing face and the lower fixing face of the holder 6 by means of the screw 36 or a fixing member (an elastic engagement between an elastic hook and an engagement portion, a so called patching engagement).

The upper first shades 13U, 13U and the lower first shades 13D, 13D are integrally configured at both of the left and right sides of the upper fixing face and the lower fixing face of the holder 6 or is integrally fixed by means of a fixing member (a screw or an elastic engagement between an elastic hook and an engagement portion, a so called patching engagement). On the other hand, the upper second shades 14U, 14U and the lower second shades 14D, 14D are integrally configured at both of the left and right sides of the window portion 8 of the reflector 300 or are integrally fixed by means of a fixing member (a screw or an elastic engagement between an elastic hook and an engagement portion, a so called patching engagement).

The constituent elements of the lamp unit, i.e., reference numerals 300, 5U, 5D, 6, 7, 12U, 12D, 13U, 13U, 13D, 13D, 14U, 14U, 14D, 14D are disposed via an optical axis adjusting mechanism, for example, in a lamp room partitioned by the lamp housing and the lamp lens. In the lamp room, as another lamp unit such as a fog lamp, there may be disposed a cornering lamp, a clearance lamp, a turn signal lamp other than the constituent elements of the lamp unit, designated by reference numerals, 300, 5U, 5D, 6, 7, 12U, 12D, 13U, 13U, 13D, 13D, 14U, 14U, 14D, 14D.

Figure 23:
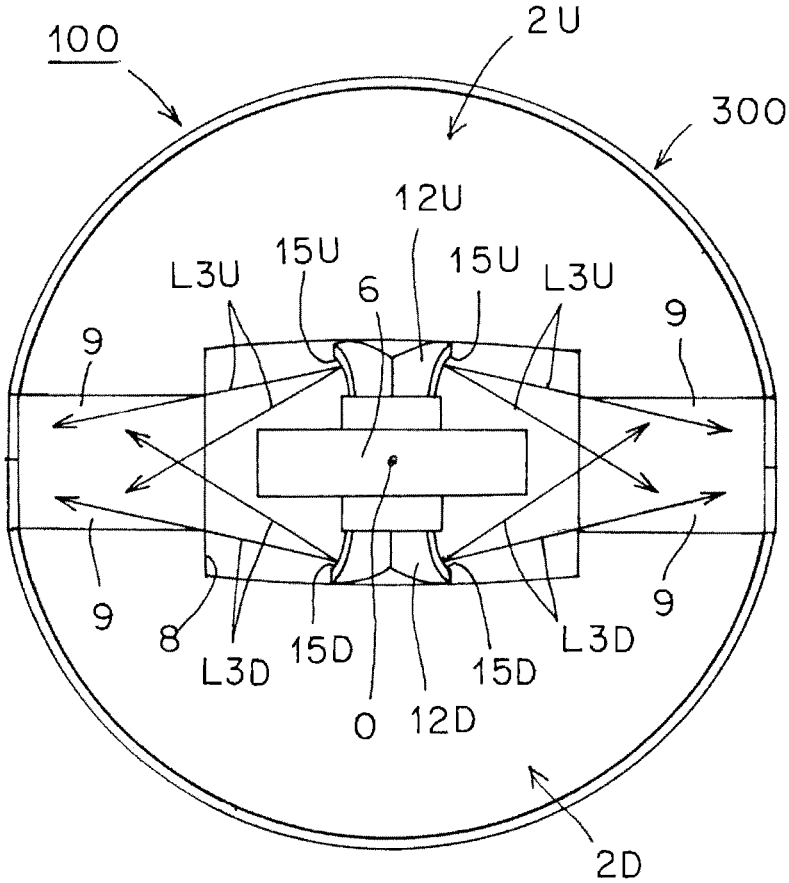
FIG. 23 is an explanatory view showing an optical path of reflection light to be reflected from the first additional reflection surface to a second reflection surface, similarly.

Two of the second additional reflection surfaces 9, 9 that are defined at both of the left and light sides of the upside unit; and two of the second additional reflection surfaces 9, 9 that are defined at both of the left and right sides of the downside unit, are common as shown in FIG. 23 in the embodiment. These reflection surfaces are disposed between the main reflection surface 2U of the upside unit and the main reflection surface 2D of the downside unit. As a result, reflected light L3U from the upper first additional reflection surfaces 15U, 15U and reflected light L3D from the lower first additional reflection surfaces 15D, 15D are incident to two of the second additional reflection surfaces 9, 9 that are defined at both of the left and right sides of the upside unit and two of the second additional reflection surfaces 9, 9 that are defined at both of the left and right sides of the downside unit, respective ones of which are common. Further, the incident light is radiated to the forward direction of the vehicle as a predetermined additional light distribution pattern.

Figure 24:
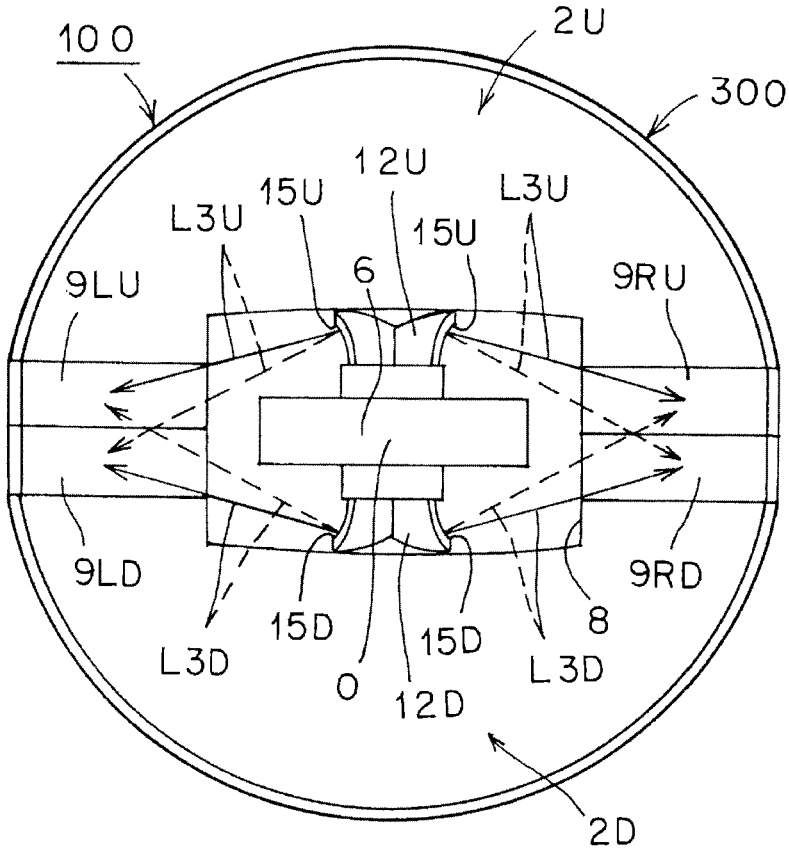
FIG. 24 is an explanatory view showing a first modified example of the optical path of the reflection light to be reflected from the first additional reflection surface to the second additional reflection surface.

There are several cases in which two of the second additional reflection surfaces 9, 9 that are defined at both of the left and right of the upside unit; and two of the second additional reflection surfaces 9, 9 that are defined at both of the left and right sides of the downside unit, are shared at both of the upper and lower sides, respectively, as shown in FIG. 24, for example. In other words, there are several cases in which the second additional surface that is defined at the left side is shared with an upper portion 9LU and a lower portion 9LD; and the second additional reflection surface that is defined at the right side is shared with an upper portion 9RU and a lower portion 9RD.

For example, one case is that in which there are arranged: second additional reflection surfaces 9LU, 9RU that are defined at the upper left and right, for the sake of incidence of reflected light L3U (the reflected light L3U that is indicated by the solid line) from the first additional reflection surfaces 15U, 15U of the upside unit; and second additional reflection surfaces 9LD, 9RD that are defined at the lower left and right for the sake of incidence of reflected light L3D (the reflected light L3D that is indicated by the solid line) from the first additional reflection surfaces 15D, 15D of the downside unit. In addition, another case is that in which there are arranged: second additional reflection surfaces 9LD, 9RD that are defined at the lower left and right for incidence of reflected light L3D (the reflected light L3D indicate by the solid line) from the first additional reflection surfaces 15D, 15D of the downside unit; and second additional reflection surfaces 9LU, 9RU that are defined at the upper left and right, for the sake of incidence of reflected light L3D (the reflected light that is indicated by the dashed line); and second additional reflection surfaces 9LU, 9RU that are defined at the upper left and right for the sake of incidence of reflected light L3D (the reflected light L3D that is indicated by the dashed line). Further, still another case is that in which there are arranged: a second additional reflection surface 9LU that is defined at the upper left and a second additional reflection surface 9RD that is defined at the lower right, for the sake of incidence of the reflected light L3U (the left side corresponds to the reflected light L3U that is indicated by the solid line and the right side corresponds to the reflected light L3U that is indicated by the dashed line) from the first additional reflection surfaces 15U, 15U of the upside unit; and a second additional reflection surface 9LD that is defined at the lower left and a second additional reflection surface 9RU that is defined at the upper right, for the sake of incidence of reflected light L3D (the left side corresponds to the reflected light L3D that is indicated by the solid line and the right side corresponds to the reflected light L3D that is indicated by the dashed line) from the first additional reflection surfaces 15D, 15D of the downside unit and reflected light L3D (the left side corresponds to the reflected light L3D that is indicated by the solid line and the right side corresponds to the reflected light that is indicated by the dashed line) from the first additional reflection surfaces 15D, 15D of the downside unit. Still furthermore, yet another case is that in which there are arranged: a second additional reflection surface 9LD that is defined at the lower left and a second additional reflection surface 9RU that is defined at the upper right, for the sake of incidence of reflected light L3U (the left side corresponds to the reflected light that is indicated by the dashed line and the right side corresponds to the reflected light L3U that is indicated by the solid line) from the first additional reflection surfaces 15U, 15U of the upside unit; and a second additional reflection surface 9LU that is defined at the upper left and a second additional reflection surface 9RD that is defined at the lower right, for the sake of incidence of reflected light L3D (the left side corresponds to the reflected light L3D that is indicated by the dashed line and the right side corresponds to the reflected light that is indicated by the solid line) from the first additional reflection surfaces 15D, 15D of the downside unit.

Figure 25:
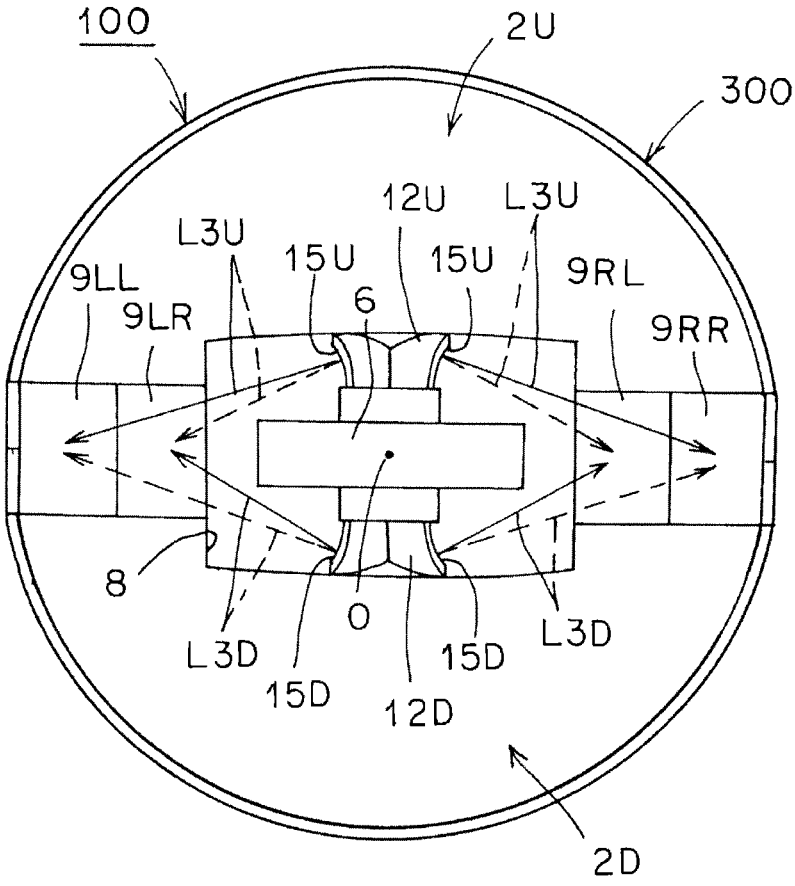
FIG. 25 is an explanatory view showing a second modified example of the optical path of the reflection light to be reflected from the first additional reflection surface to the second additional reflection surface, similarly.

In addition, there are several cases in which two of the second additional reflection surfaces 9, 9 that are defined at both of the left and right sides of the upside unit; and two of the second additional surfaces 9, 9 that are defined at both of the left and right sides of the downside unit, may be shared respectively at both of the left and right sides, as shown in FIG. 25, for example. In other words, there are several cases in which the second additional reflection surface that is defined at the left side may be shared with a portion 9LL at the left side and a portion 9LR that is defined at the right side and a second additional reflection surface that is defined at the left side may be shared with a portion 9RL that is defined at the left side and a portion 9RR that is defined at the right side in any of the following cases.

For example, one case is that in which there are arranged: a second additional reflection surface 9LL that is defined at the left-left side and a second additional reflection surface 9RR that is defined at the right-right side, for the sake of incidence of reflected light L3U (the reflected light L3U that is indicated by the solid line) from the first additional reflection surfaces 15U, 15U of the upside unit; and a second additional reflection surface 9LR that is defined at the left-right side and a second additional reflection surface 9RL that is defined at the right-left side, for the sake of incidence of reflected light L3D (the reflected light L3D that is indicated by the solid line) from the first additional reflection surface 15D, 15D of the downside unit. In addition, another case is that in which there are arranged: a second additional reflection surface 9LR that is defined at the left-right side and a second additional reflection surface 9RL that is defined at the right-left side, for the sake of incidence of reflected light L3U (the reflected light L3U that is indicated by the dashed line) from the first additional reflection surfaces 15U, 15U of the upside unit; and a second additional reflection surface 9LL that is defined at the left-left side and a second additional reflection surface 9RR that is defined at the right-right sides, for the sake of incidence of reflected light L3U (the left side corresponds to the reflected light L3U that is indicated by the solid line and the right side corresponds to the reflected light L3U that is indicated by the dashed line) from the first additional reflection surfaces 15U, 15U of the upside unit; and a second additional reflection surface 9LR that is defined at the left-right side and a second additional reflection surface 9RR that is defined at the right-right side, for the sake of incidence of reflected light L3D (the left side corresponds to the reflected light L3D that is indicated by the solid line and the right side corresponds to the reflected light L3D that is indicated by the dashed line) from the first additional reflection surfaces 15D, 15D of the downside unit. Further, still another case is that in which there are arranged: a second additional reflection surface 9LL that is defined at the left-left side and a second additional reflection surface 9RL that is defined at the right-left side, for the sake of incidence of reflected light L3U (the left side corresponds to the reflected light L3U that is indicated by the solid line and the right side corresponds to the reflected light L3U that is indicated by the dashed line) from the first additional reflection surfaces 15D, 15D of the downside unit. Furthermore, yet another case is that in which there are arranged: a second additional reflection surface 9LR that is defined at the left-right side and a second additional reflection surface 9RR that is defined at the right-right side, for the sake of incidence of reflected light L3U (the left side corresponds to the reflected light L2U that is indicated by the dashed line and the right side corresponds to the reflected light L3U that is indicated by the solid line) from the first additional reflection surfaces 15U, 15U of the upside unit; and a second additional reflection surface 9LL that is defined at the left-left side and a second additional reflection surface 9RL that is defined at the right-left side, for the sake of incidence of reflected light L3D (the left side corresponds to the reflected light L3D that is indicated by the dashed line and the right side corresponds to the reflected light L3D that is indicated by the solid line) from the first additional reflection surfaces 15D, 15D of the downside unit.

The vehicle headlamp 100 in the second embodiment is made up of the constituent elements as described above, so that the headlamp can achieve the functions and advantageous effects that are substantially similar to those of the vehicle headlamp 1 in the first embodiment.

In particular, according to the vehicle headlamp 100 in the second embodiment, in the main reflection surfaces 2U, 2D; the semiconductor-type light sources 5U, 5D; the light shading members 12U, 12D; the first additional reflection surfaces 15U, 15U, 15D, 15D; the second additional reflection surfaces 9, 9; the first shades 13U, 13U, 13D, 13D; the second shades 14U, 14U, 14D, 14D; and openings 16U, 16U, 16D, 16D, the constituent elements of the upside unit in which a light emitting surface of the light emitting chip 4 is oriented upward in the vertical Y-axis direction (in other words, the upper reflection surfaces 2U and the upper semiconductor-type light source 5U of the first embodiment) and the constituent elements of the downside unit in which the light emitting surface of the light emitting chip 4 is oriented downward in the vertical Y-axis direction (in other words, the lower reflection surface 2D and the lower semiconductor-type light source 5D) are disposed so as to be established in a point-symmetrical state while a point O is defined as a center. As a result, according to the vehicle headlamp 100 in the second embodiment, even if a reflector 300 is reduced in size, the light quantity (luminous intensity, intensity of illumination) of a predetermined light distribution pattern LP for low beam and a predetermined additional light distribution pattern LP1 can be sufficiently obtained, so that optically distributing and controlling a predetermined light distribution pattern LP for low beam and a predetermined additional light distribution pattern LP1 that are suitable for use in vehicle can be compatible with downsizing a lamp unit.

In addition, according to the vehicle headlamp 100 in the second embodiment, the second additional reflection surfaces 9, 9 of the upside unit and the second additional reflection surfaces 9, 9 of the downside unit are disposed between the main reflection surface 2U of the upside unit and the main reflection surface 2D of the downside unit. As a result, the vehicle headlamp 100 in the second embodiment entirely illuminates: the second additional reflection surfaces 9, 9 of the upside unit, which are positioned partway, and the second additional reflection surfaces 9, 9 of the downside unit; the main reflection surface 2U of the upside unit positioned at the upper side; and the main reflection surface 2D of the downside unit positioned at the lower side. Thus, according to the vehicle headlamp 100 in the second embodiment, visibility or quality is improved because a non-luminous portion is not formed between the main reflection surface 2U of the upside unit and the main reflection surface 2D of the downside unit.

Further, according to the vehicle headlamp 100 in the second embodiment, there are arranged respectively separately: the reflector 300; the upper semiconductor-type light source 5U; the lower semiconductor-type light source 5D; the holder 6; the heat sink member 7; the upper light shading member 12U; the lower light shading member 12D; two pairs of the upper shades 13U, 13U, 14U, 14U; two pairs of the lower shades 13D, 13D, 14D, 14D. Therefore, its structure, its light shading process, and its light reflection process are simplified and its manufacturing cost can be lowered.

In the second embodiment, two of the first upper and lower additional reflection surfaces 15U, 15U, 15D, 15D are provided at the left and right of one of the light shading members 12U, 12D. In addition, two of the upper and lower second additional reflection surfaces 9, 9 are provided at the left and right of one reflector 300. Further, the upper and lower shades, i.e., two of the upper and lower first shades 13U, 13U, 13D, 13D and two of the second upper and lower additional reflection surfaces 14U, 14U, 14D, 14D are provided at the left and right between the upper and lower first additional reflection surfaces 15U, 15U, 15D, 15D and the upper and lower second additional reflection surfaces 9, 9, 9, 9. However, in the present invention, a first additional reflection surface, a second additional reflection surface, and shades, i.e., a first shade and a second shade may be provided at only the left side or only at the right side on a one-by-one piece basis.

Third Embodiment

Figure 26:
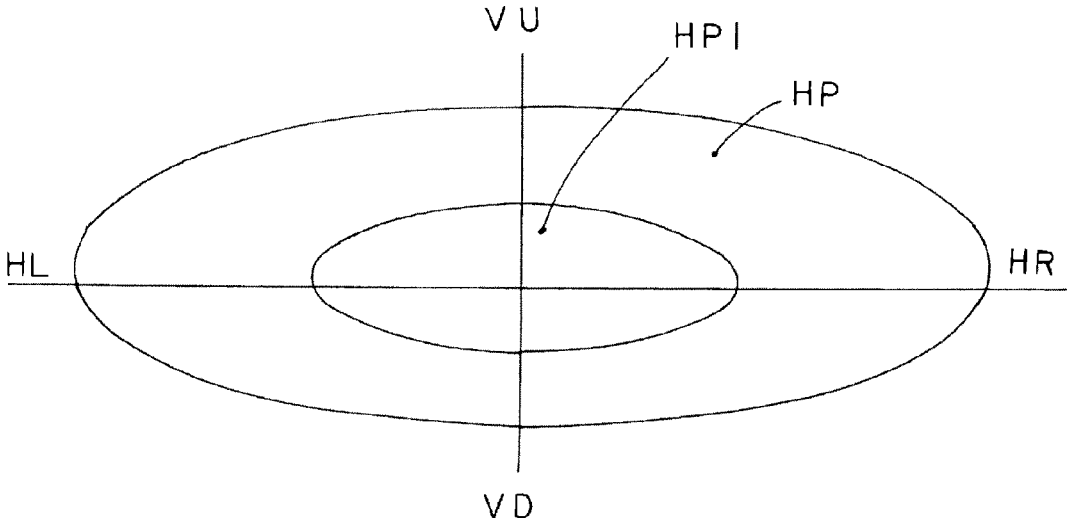
FIG. 26 is an explanatory view showing a light distribution pattern for high beam, showing a vehicle headlamp according to a third embodiment of the present invention.

FIG. 26 shows a vehicle headlamp according to a third embodiment of the present invention. Hereinafter, the vehicle headlamp in the third embodiment will be described. In the figure, like constituent elements shown in FIG. 1 to FIG. 25 are designated by like reference numerals. The vehicle headlamp in the third embodiment emits a light distribution pattern for high beam (a light distribution pattern for running) HP as a predetermined main light distribution pattern and emits an additional light distribution pattern HP1 including a center portion of the light distribution pattern HP for high beam, as a predetermined additional light distribution pattern.

According to the vehicle headlamp in the third embodiment, the reflection surface of each of the segments 21 to 28 of main reflection surfaces 2U, 2D is defined as a reflection surface adapted to emit the light distribution pattern HP for high beam as the predetermined light distribution pattern. In addition, there is no need to use the first shades 13U, 13U, 13D, 13D and the second shades 14U, 14U, 14D, 14D, and the reflection surfaces of the first additional reflection surfaces 15U, 15U, 15D, 15D and the second additional reflection surfaces 9, 9, 9, 9 are defined as reflection surfaces adapted to emit the additional light distribution pattern HP1 as the predetermined additional light distribution pattern.

The vehicle headlamp in the third embodiment is made up of the above-described constituent elements, so that the headlamp can achieve the functions and advantageous effects that are substantially similar to those of the vehicle headlamps 1, 100 in the first and second embodiments. In particular, the vehicle headlamp in the third embodiment can emit the light distribution pattern HP for high beam and the additional light distribution pattern HP1.

While the first and second embodiments describe: a light distribution pattern LP for low beam, the pattern having cutoff lines CL1, CL2, as a predetermined main light distribution pattern; and an additional light distribution pattern LP1 having cutoff lines CL1, CL2 as a predetermined additional light distribution pattern, the third embodiment describes a light distribution pattern HP for high beam as a predetermined light distribution pattern and an additional light distribution pattern HP1 as a predetermined additional light distribution pattern. However, in the present invention, there may be formed: a predetermined main light distribution pattern and a predetermined additional light distribution pattern other than a light distribution pattern LP1 for low beam, the pattern having cutoff lines CL1, CL2; an additional light distribution pattern LP1 having cutoff lines CL1, CL2; and a light distribution pattern HP for high beam and/or additional light distribution pattern HP1. For example, there may be formed a light distribution pattern having an oblique cutoff line on the running lane and a horizontal cutoff line at an opposite lane with an elbow point being a turning point, such as a light distribution pattern for expressway or a light distribution pattern for fog lamp, for example. Alternatively, there may be formed a light distribution pattern which does not have a cutoff line.

The first, second, and third embodiments describe vehicle head lamps 1, 100 for left-side running lane. However, the present embodiment can be applied to a vehicle headlamp for right-side running lane.

What is claimed is:

1. A vehicle headlamp whose semiconductor-type light source is used as a light source, the vehicle headlamp comprising:

a reflector having a main reflection surface that is made up of a parabolic free-curved face;

a semiconductor-type light source having a light emitting chip; and a light shading member, wherein:

a center of the light emitting chip is positioned at or near a reference focal point of the main reflection surface and is positioned on a reference optical axis of the main reflection surface;

a light emitting surface of the light emitting chip is oriented in a vertical axis direction;

the main reflection surface is a main reflection surface which is disposed in a space at a side opposite to the light emitting surface of the light emitting chip and which is adapted to reflect light radiated from the light emitting surface of the light emitting chip and then emit the reflected light to a forward direction of a vehicle in a predetermined main light distribution pattern;

the light shading member which is disposed in at least a space other than an optical path which is emitted with light from the main reflection surface to the forward direction of the vehicle and is adapted to shade light directly radiated from the light emitting surface of the light emitting chip to the forward direction of the vehicle;

on the light shading member, there is provided: a first additional reflection surface that is made up of an elliptical free-curved face in which a first reference focal point is positioned at or near a reference focal point of the main reflection face and a second reference focal point is positioned on a reference optical axis of the main reflection surface and a horizontal axis orthogonal to the vertical axis or at an opposite side to a side opposing to a light emitting surface of the light emitting chip of the horizontal axis, the first additional reflection surface being adapted to converge and reflect light directly radiated from the light emitting surface of the light emitting chip to the forward direction of the vehicle on the second reference focal point; and at a site other than the main reflection surface and at an opposite side to a side opposing to the light emitting surface of the light emitting chip of the main reflection surface, of the reflector, there is provided a second additional reflection surface that is made up of a parabolic free-curved face in which a reference focal point is positioned at or near a second reference focal point of the first additional reflection surface, the second additional reflection surface being adapted to reflect reflected light from the first additional reflection surface and then emit the reflected light to the forward direction of the vehicle in a predetermined additional light distribution pattern.

2. The vehicle headlamp according to claim 1, wherein:

the first additional reflection surface is made up of two elliptical free-curved faces in which the first reference focal point is shared and the second reference focal point are positioned at each of the left and right sides with respect to the semiconductor-type light source; and the second additional reflection surface is made up of two parabolic free-curved faces that are positioned at both the left and right sides with respect to the semiconductor-type light source.

3. The vehicle headlamp according to claim 1, wherein the main reflection surface, the semiconductor-type light source, the light shading member, one or two of the first additional reflection surfaces, and one or two of the second additional reflection surfaces are disposed so that an upside unit in which the light emitting surface of the light emitting chip is oriented upward in a vertical axis direction and a downside unit in which the light emitting surface of the light emitting chip is oriented downward in the vertical axis direction are established in a point-symmetrical state.

4. The vehicle headlamp according to claim 3, wherein one or two of the second additional reflection surfaces of the upside unit and one or two of the second additional reflection surfaces of the downside unit are disposed between the main reflection surface of the upside unit and the main reflection surface of the downside unit.

5. The vehicle headlamp according to claim 1, wherein:

the main light distribution pattern is a main distribution pattern having a cutoff line and the at least one shade adapted to form an additional light distribution pattern having a cutoff line is provided in a space other than the optical path which is emitted with light from the main reflection surface to the forward direction of the vehicle and between the first additional reflection surface and the second reflection surface.

6. The vehicle headlamp according to claim 5, wherein:

the first additional reflection surface is made up of an elliptical free-curved face in which the first reference focal point is shared and the second reference focal point is positioned at each of the left and right sides with respect to the semiconductor-type light source;

the second additional reflection surface is made up of two parabolic free-curved faces that are positioned at both of the left and right sides with respect to the semiconductor-type light source; and the at least one shade is made up of two shades that are provided between two of the first additional reflection surfaces and two of the second additional reflection surfaces, respectively.

7. The vehicle headlamp according to claim 5, wherein the at least one shade is positioned at or near the second reference focal point of the first additional reflection surface.

8. The vehicle headlamp according to claim 5, wherein:

the main reflection surface, the semiconductor-type light source, the light shading member, one or two of the first additional reflection surfaces, and one or two of the second additional reflection surfaces are provided so that the upside unit in which the light emitting surface of the light emitting chip is oriented upward in a vertical axis direction and the downside unit in which the light emitting surface of the light emitting chip are oriented downward in the vertical axis direction are established in a point-symmetrical state; and one or two of the two shades are provided at the upside unit in which the light emitting face of the light emitting chip is oriented upward in the vertical axis direction and at the downside unit in which the light emitting face of the light emitting chip is downward in the vertical axis direction, respectively.

* * * * *